United States Patent [19]

Schirmer

[11] 4,007,002

[45] Feb. 8, 1977

[54] COMBUSTORS AND METHODS OF OPERATING SAME

[75] Inventor: Robert M. Schirmer, Bartlesville, Okla.

[73] Assignee: Phillips Petroleum Company, Bartlesville, Okla.

[22] Filed: Apr. 14, 1975

[21] Appl. No.: 567,830

[52] U.S. Cl. ..... 431/10; 60/39.65; 431/11; 431/352

[51] Int. Cl.[2] ..... F23D 11/44

[58] Field of Search ..... 431/215, 10, 11, 352, 431/158; 60/39.65, 39.29, 39.52; 432/222

[56] References Cited

UNITED STATES PATENTS 3,865,538 4/1974 Quigg ..... 431/352 X

*Primary Examiner*—Edward G. Favors

[57] ABSTRACT

New combustors, and methods of operating same, which produce lower emissions, particularly lower emissions of nitrogen oxide and CO, are provided. Means and methods are provided for supplying separate streams of air to first and second combustion regions of a combustor, and expanding combustion products when passing same from said first combustion region to said second combustion region. The combustors of the invention are characterized by the relatively small volume of said first combustion region as compared to the total volume of said first combustion region and said second combustion region; and methods and means provided for introducing first and second streams of air to said first and second regions, respectively. In some embodiments of the invention unheated air is used in the first combustion region. In other embodiments of the invention heated air is used in said first combustion region.

37 Claims, 21 Drawing Figures

COMBUSTORS AND METHODS OF OPERATING SAME

This invention relates to new combustors and methods of operating same.

Air pollution has become a major problem in the United States and other highly industrialized countries of the world. Consequently, the control and/or reduction of said pollution has become the object of major research and development effort by both governmental and nongovernmental agencies. Combustion of fossil fuel is a primary source of said pollution. It has been alleged, and there is supporting evidence, that the automobiles employing conventional piston-type engines burning hydrocarbon fuels are a major contributor to said pollution. Vehicle emission standards have been set by the United States Environmental Protection Agency (EPA) which are sufficiently restrictive to cause automobile manufacturers to consider employing alternate engines instead of the conventional piston engine.

The gas turbine engine is being given serious consideration as an alternate engine. CO emissions in conventional prior art gas turbine engine processes operated for maximum fuel combustion efficiency are not usually a problem. However, nitrogen oxides emissions, usually referred to as $NO_x$, are a problem because the high temperatures generated in such prior art processes favor the production of $NO_x$. It has been proposed to reduce the temperature of the inlet combustion air flowing to the combustion apparatus so as to reduce the amount of nitrogen oxides produced. For example, see the U.S. Pat. No. 3,705,492, to Vickers, Dec. 12, 1972. However, there is no disclosure in said Vickers patent of what happens to the production of CO emissions. A gas turbine engine employed in an automobile or other vehicle will be operated over a wide range of varying operating conditions including idle, low speed, moderate speed, high speed, acceleration, and deceleration. These varying conditions also create serious problems in controlling both $NO_x$ and CO emissions. Frequently, when a combustor is operated for the control of one of $NO_x$ or CO emissions, control of the other is lost. Both must be controlled. Thus, there is a need for a combustor of practical and/or realistic design, which can be operated in a manner such that the pollutant emissions therefrom will meet said EPA standards. Even a combustor, and/or a combustion process, giving reduced pollutant emissions approaching said standards would be a greater advance in the art. Such a combustor, or process, would have great potential value because it is possible the presently very restrictive EPA standards may be reduced even further than has been recently indicated.

The present invention solves the above-described problems by providing new combustors, and methods of operating same, which produce lower emissions, particularly lower emissions of nitrogen oxides (usually referred to as $NO_x$) and CO. The combustors of the invention are particularly superior in their ability to operate with unheated air supplied to the first combustion region. Thus, in one embodiment of the invention, means and methods are provided for operating the combustors of the invention with unheated air supplied to the first combustion region of the combustor and supplying heated air to a second combustion region of the combustor. However, the use of unheated air, i.e., air which has bypassed the regenerator, results in a loss of efficiency which is exhibited by increased fuel requirements. Thus, for some installations at least, the use of bypass or unheated air is not preferred.

The combustors of the invention can be operated with heated air in the first combustion region, as well as the second combustion region. However, as shown by the examples given hereinafter, it has been found that for best results that when heated air is used in the first combustion region, the amount of heated air supplied to said first combustion region should be controlled in accordance with the fuel flow. Thus, in another embodiment of the invention, means and methods are provided for operating the combustors of the invention with heated air to both the first combustion region and the second combustion region, and controlling the amount of air to the first combustion region in accordance with the fuel flow. Still other embodiments of the invention will be described hereinafter in connection with the description of the drawings and the examples.

Thus, according to the invention, there is provided a combustor comprising, in combination: an outer casing; a flame tube disposed within said casing and spaced apart therefrom to form a first annular chamber between said flame tube and said casing; said flame tube having an upstream first combustion section, and a second combustion section downstream from said first combustion section, wherein the volume of said first combustion section is within the range of from 0.7 to 4 percent of the total volume of said first combustion section and said second combustion section; a first air inlet means for introducing a first stream of swirling air into the upstream end portion of said flame tube; a fuel inlet means for introducing fuel into the upstream end portion of said flame tube; and a plurality of openings provided in the wall of said flame tube at a first station located between said first combustion section and said second combustion section for admitting a segmented second stream of air from said annular chamber into the interior of said flame tube.

Further according to the invention, there is provided a method for burning a fuel in a combustion zone having a first upstream combustion region and a second combustion region located downstream from said first combustion region, which method comprises: introducing a stream of fuel into the upstream end portion of said first combustion region; introducing a swirling first stream of air into said upstream end portion of said first combustion region and forming a combustible mixture of said fuel and said air; causing ignition of said combustible mixture so as to cause combustion thereof; introducing a segmented second stream of air into said mixture, at a location between said first combustion region and said second combustion region, as a plurality of individual streams of air spaced apart around said location and causing the formation of regions of relatively low pressure between said individual streams of air; and thereby causing the flame from said combustion to be stabilized in said regions of relatively low pressure during periods of low fuel flow, and causing said flame to be stabilized in said second combustion region during periods of high fuel flow.

Referring now to the drawings, wherein like or similar reference numerals are employed to denote like or similar elements the invention will be more fully explained.

Figure 1:
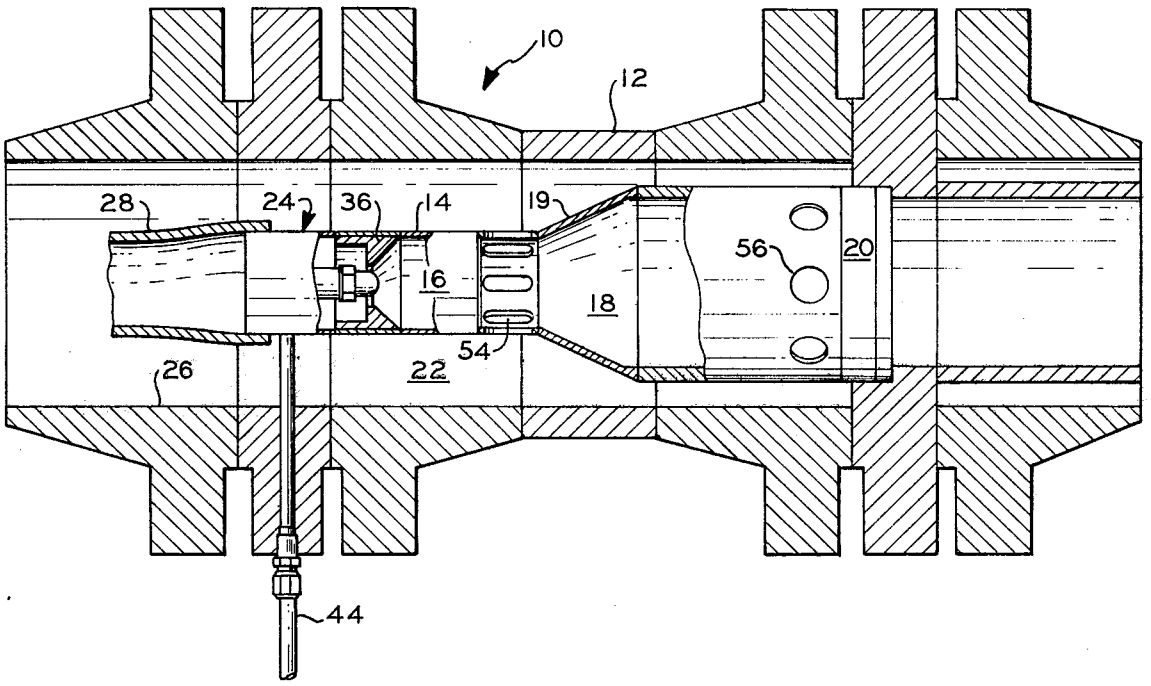
FIG. 1 is a view, partially in cross section, of a control combustor employed in evaluating the combustors of the invention.

FIG. 1 illustrates a control combustor, denoted generally by the reference numeral 10 which was employed for comparison purposes in evaluating the combustors of the invention. Said combustor comprises an outer housing or casing 12 having a flame tube 14 disposed, preferably concentrically, therein. Said flame tube can be supported in said housing or casing by any suitable means. Said flame tube comprises a primary combustion section 16 disposed in the upstream portion thereof, a secondary combustion section 18 located downstream from said primary combustion section, and a dilution or quench section 20 located downstream from said secondary combustion region. A tapered annular connecting section 19 of greater cross sectional area than said primary combustion section is disposed in the upstream portion of said secondary combustion section 18 and comprises the upstream end portion of said secondary combustion section. Preferably, the downsteam portion of said secondary combustion section is enlarged and has a greater cross sectional area than said connecting section. Said primary, connecting, secondary, and quench sections are preferably generally circular in cross section throughout their length.

An annular chamber 22 is formed around said flame tube 14 and between said flame tube and said outer housing 12. Said annular chamber 22 is closed at its downstream end by any suitable means such as that illustrated. The upstream end of said flame tube is closed by a dome or closure member designated generally by the reference numeral 24, and having fuel inlet means and primary combustion air inlet means incorporated therein. A first air conduit 26 is connected to the upstream end of said outer casing 12 by any suitable means and communicates with said first annular chamber 22 for admitting air, preferably heated air, thereto. A second air conduit 28 is connected to the upstream end of dome or closure member 24 and communicates therewith for admitting air, preferably unheated primary combustion air thereto, e.g., from conduit 28 and into the primary combustion section of the flame tube. See FIG. 2. Said air conduit 28 can be connected to and communicate with the upstream end portion of said dome member 24 in any suitable manner which is effective to exclude air in said first air conduit 26 from entering the air inlet means incorporated in said dome member, but which is effective to permit air from said second air conduit 28 to enter said air inlet means. Although not shown in the drawing, it will be understood that said conduit 28 extends through the wall of conduit 26 in any suitable manner and is connected to a source of unheated air, e.g., air which has by-passed the regenerator. Similarly, it will be understood that conduit 26 is connected to a source of heated air, e.g., air which has passed through the regenerator.

Figure 3:
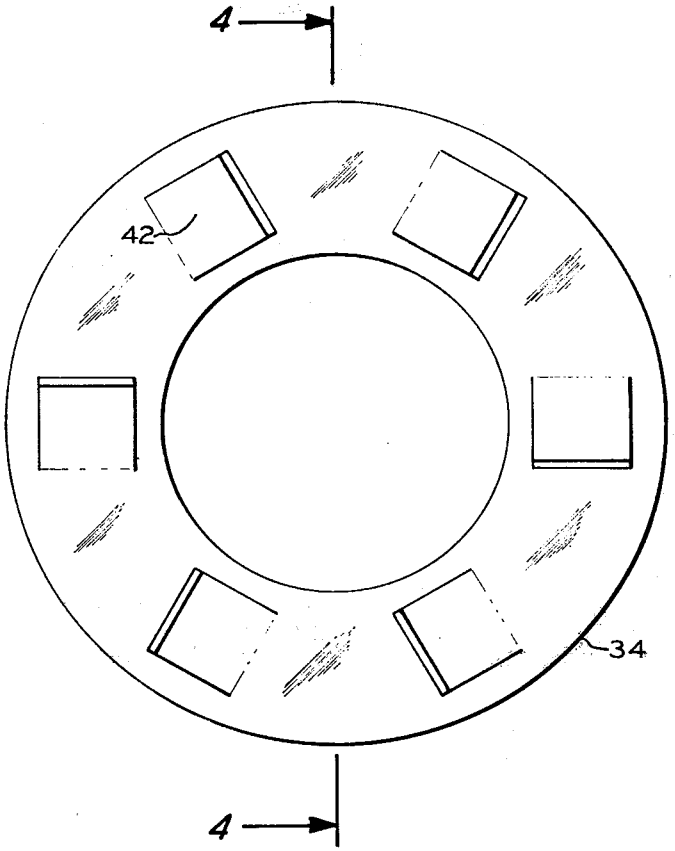
FIG. 3 is a view taken along the line 3—3 of FIG. 2 and illustrating the swirl plate of the dome or closure member of said FIG. 2.
Figure 4:
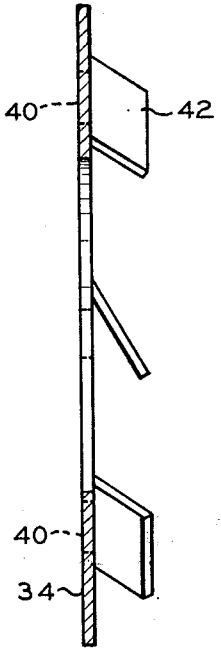
FIG. 4 is a sectional view taken along the line 4—4 of FIG. 3.
Figure 2:
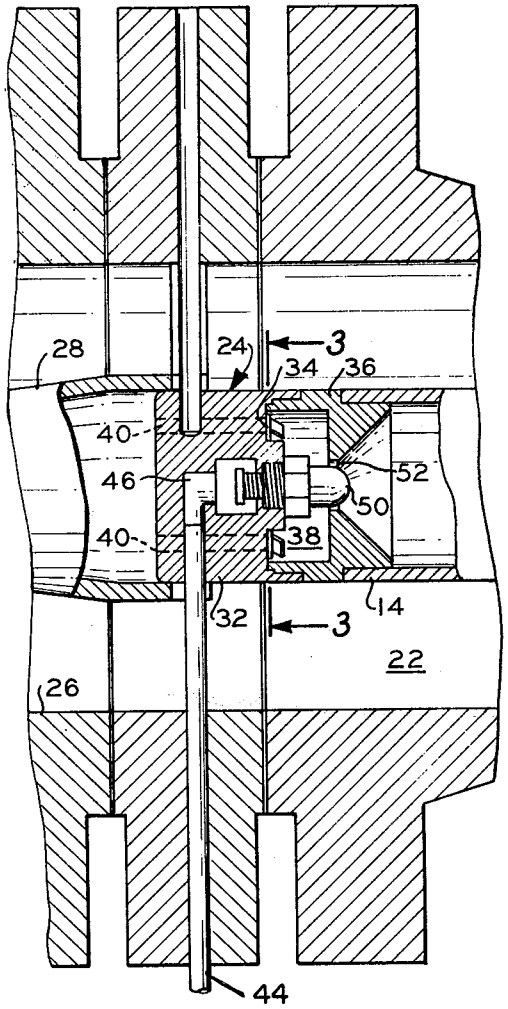
FIG. 2 is an enlarged view in cross section of the dome or closure member employed in the upstream end of the flame tube in the combustors illustrated in FIGS. 1, 5, and 6.

Referring to FIGS. 2, 3 and 4, said dome or closure member 24 can be fabricated integrally, i.e., as one element. However, in most instances it will be preferred to fabricate said closure member in a plurality of pieces, e.g., an upstream element 32, a swirl plate 34 (see FIGS. 3 and 4), and a downstream element or radiation shield 36. A first or primary air inlet means is provided for introducing a swirling mass of air into swirl chamber 38 which is formed between swirl plate 34 and radiation shield 36, and then into the upstream end of the flame tube 14. As illustrated in FIGS. 2, 3, and 4, said air inlet means comprises a plurality of air conduits 40 and 40′ extending through said upstream member 32 and said swirl plate 34, respectively. A plurality of angularly disposed baffles 42, one for each of said air conduits 40, are formed on the downstream side of said swirl plate 34 adjacent the outlets of said air conduits 40 and 40′. Any other suitable air inlet means can be used to introducing primary air into said flame tube. Preferably, said air will be introduced as a swirling stream of air.

A fuel inlet means is provided for introducing a stream of fuel into the upstream end of said flame tube. As illustrated in FIG. 2, said fuel inlet means comprises a fuel conduit 44 leading from a source of fuel, communicating with a passageway 46 formed in upstream element 32. A spray nozzle 50 is mounted in said upstream element 32 and extends into a suitable opening 52 in said element 36, thus extends through swirl chamber 38 and is in communication with said passageway 46. Any other suitable type of spray nozzle and fuel inlet means can be employed, including air assist atomization nozzles. For example, it is within the scope of the invention to employ other nozzle types for atomizing normally liquid fuels such as nozzles wherein a stream of air is passed through the nozzle along with the fuel. Preferably, said fuel will be introduced axially with respect to, and will be surrounded by, said swirling stream of air. Preferably, the downstream end portion of said dome member 24 comprises an expansion passageway which flares outwardly from said opening 52 to the inner wall of flame tube 14.

At least one opening 54 is provided in the wall of flame tube 14 at a first station which is located between said primary combustion section 16 and said secondary combustion section 18 for admitting a second stream of air, preferably heated air, into the interior of said flame tube. At least one opening 56 is provided in the wall of said flame tube at a second station, located downstream from said first station, for admitting a third stream of air, preferably heated air, from said annular chamber 22 into said flame tube. As illustrated in FIG. 1, it is usually preferred to provide a plurality of spaced apart openings at said first and second stations.

It will be understood the combustors described herein can be provided with any suitable type of ignition means and, if desired, means for introducing a pilot fuel to initiate burning. For example, a sparkplug (not shown) can be mounted to extend into flame tube 14 adjacent the downstream end of radiation shield 36.

It will also be understood that the control combustor of FIGS. 1, 2, 3, and 4 can be operated with heated air supplied to the primary combustion section. When this operation is desired all that is necessary is to omit or remove conduit 28. Heated air from conduit 26 will then be supplied to air conduits 40 in dome member 24.

Figure 5:
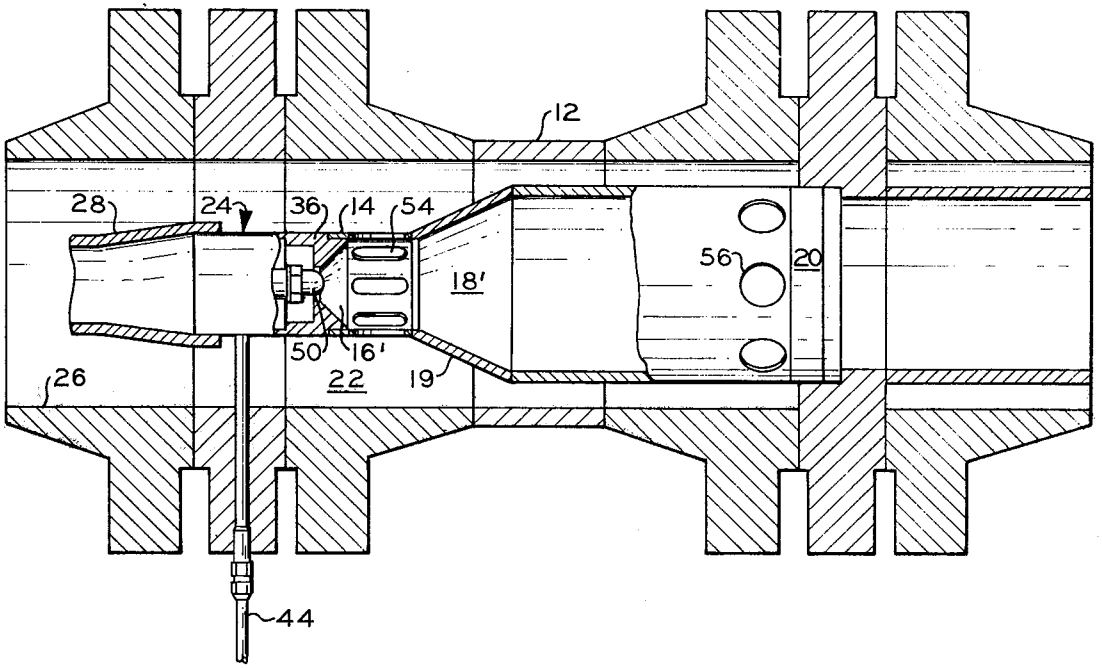
FIGS. 5, 6, and 7 are views, partially in cross section, of combustors in accordance with the invention.
Figure 6:
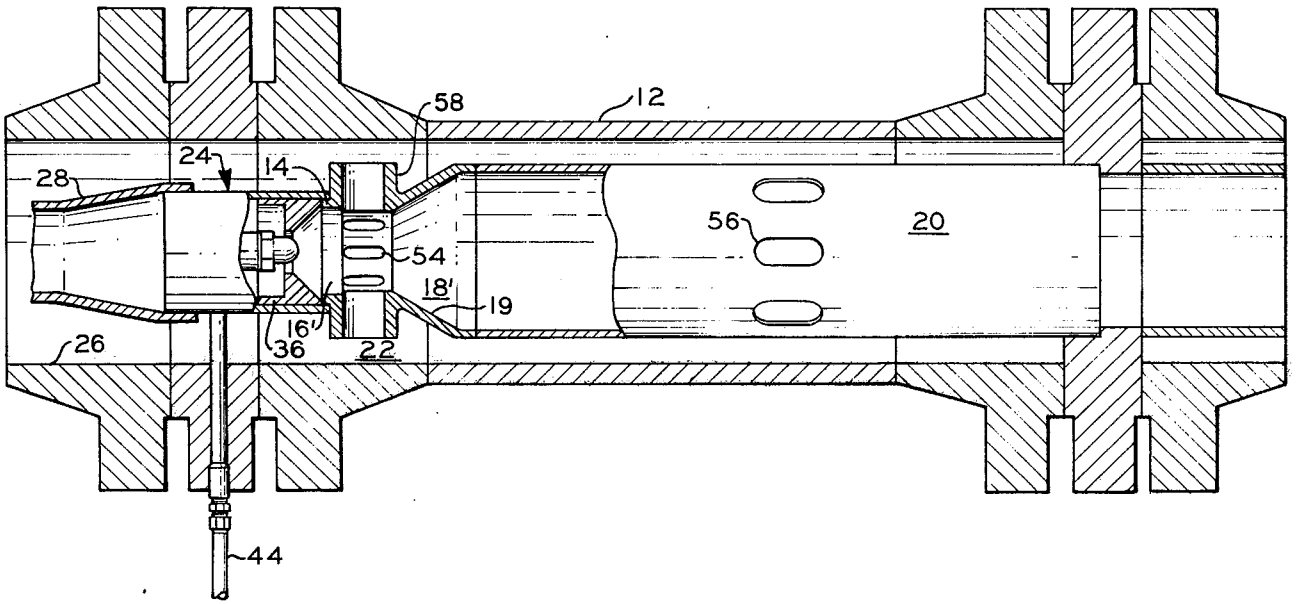

Much of the above description of the control combustor of FIGS. 1, 2, 3, and 4 is also applicable in describing the combustors of the invention which are illustrated in FIGS. 5 and 6. Thus said combustors of FIGS. 5 and 6 will be described primarily in terms of their major differences from said control combustor. It will be understood that the dome or closure member 24 in the combustors of FIGS. 5 and 6 is the same as that in the combustor of FIG. 1.

As indicated above, the combustors of the invention are characterized by the relatively small volume of the first combustion section or region as compared to the total or combined volume of said first combustion section and a second combustion section or region located downstream from said first combustion section. In the combustors of the invention the first combustion section or region will have a volume which is within the range of from 0.7 to 4, preferably 2 to 4, percent of the total or combined volume of the first combustion section or region and the second combustion section or region. The combustors of the invention can have an overall ratio of the combined length of the first combustion section and the second combustion section to the maximum cross sectional area in said second combustion section within the range of from 1.7 to about 5, preferably 2 to 4, more preferably 2 to 3. Preferably, the ratio of the length of the first combustion section to the cross sectional area of said first combustion section will be less than 1, more preferably, less than 0.75.

Referring to FIG. 5, for example, the volume of the first combustion section 16' is calculated or measured from the downstream tip of the fuel nozzle 50 to the longitudinal midpoint of first station openings 54 which are located between said first combustion section 16' and the second combustion section 18', and the volume of said second combustion section is calculated or measured from said midpoint of said openings 54 to the midpoint of the second station openings 56. The overall ratio of the length to the cross sectional area of the first combustion section and the second combustion section is calculated on the basis of the greatest cross sectional area, e.g., the second combustion section in the combustors of the invention. The ratio of the length to the cross sectional area of the first combustion section is calculated using the distance from the tip of fuel nozzle 50 to said midpoint of openings 54 as the length, and the greatest cross sectional area, e.g., the cross sectional area just upstream from said openings 54.

Referring to FIGS. 5 and 6, it will be noted that the volume of the first combustion section 16' of each of the combustors there illustrated is markedly less than the volume of the primary combustion section 16 of the combustor illustrated in FIG. 1. It will also be noted that the volume of the second combustion section 18' of the combustor of FIG. 5 is greater than the volume of secondary combustion section 18 of the combustor of FIG. 1; and that the volume of the second combustion section 18' of the combustor of FIG. 6 is greater than the volume of the second combustion section 18' of the combustor of FIG. 5. As here illustrated, the flame tube of the combustor of FIG. 6 also differs in that an individual tubular conduit 58 is provided for each of the first station openings 54. Each said tubular conduit is connected at its inner end to an individual opening 54, and the outer end of the conduit extends into first annular chamber 22. Said tubular conduits 58 are not required for the operation of the combustor of FIG. 6 and the combustor can be operated quite satisfactorily without same.

Referring to FIGS. 5 and 6, and also FIGS. 7 and 15 described hereinafter, it is preferred that the air inlet openings provided in the dome members, the first station openings 54, and the downstream quench air openings are the only openings for admitting air into the interior of the flame tube.

In one method of operating the combustors of FIGS. 5 and 6, a first stream of air, preferably unheated, from conduit 28 is introduced into the upstream end portion of first combustion section 16' via openings 40, past baffles 42, and through swirl chamber 38 in dome member 24. The baffles 42 impart a helical or swirling motion to the air entering and exiting the said swirl chamber. A stream of fuel is admitted, via conduit 44 and nozzle 50 axially of said swirling stream of air. The fuel, and the air from swirl chamber 38, are passed through the expansion passageway in radiation shield 36 wherein they are expanded in a uniform and graduated manner, during at least a portion of the mixing thereof, from the volume in the region of the initial contact therebetween to the volume of the first combustion section 16' A combustible mixture of said fuel and air is formed and ignited so as to cause combustion thereof.

A second stream of air, preferably heated air, is passed from conduit 26 in a downstream direction through annular chmber 22 in the region around said first combustion section 16'. A portion of said second stream of air is introduced via openings 54 into the interior of the flame tube 14 at a first station located between first combustion section 16' and second combustion section 18'. Said air is introduced into said mixture in segmented form as a plurality of spaced apart individual streams of air from said openings 54. The resulting mixture is passed via annular connecting section 19, and expanded during said passage, into the enlarged portion of second combustion section 18'. Another portion of said second stream of air is passed from annular chamber 22 via openings 56 into the downstream end portion of the flame tube as diluent or quench air.

As discussed further hereinafter in connection with the examples, the combustors of FIGS. 5 and 6 can be operated when using heated air in the first combustion section. Also, as illustrated in connection with the examples, the operation of the combustor of FIG. 1 is similar to that described for the combustors of FIGS. 5 and 6.

Figure 7:
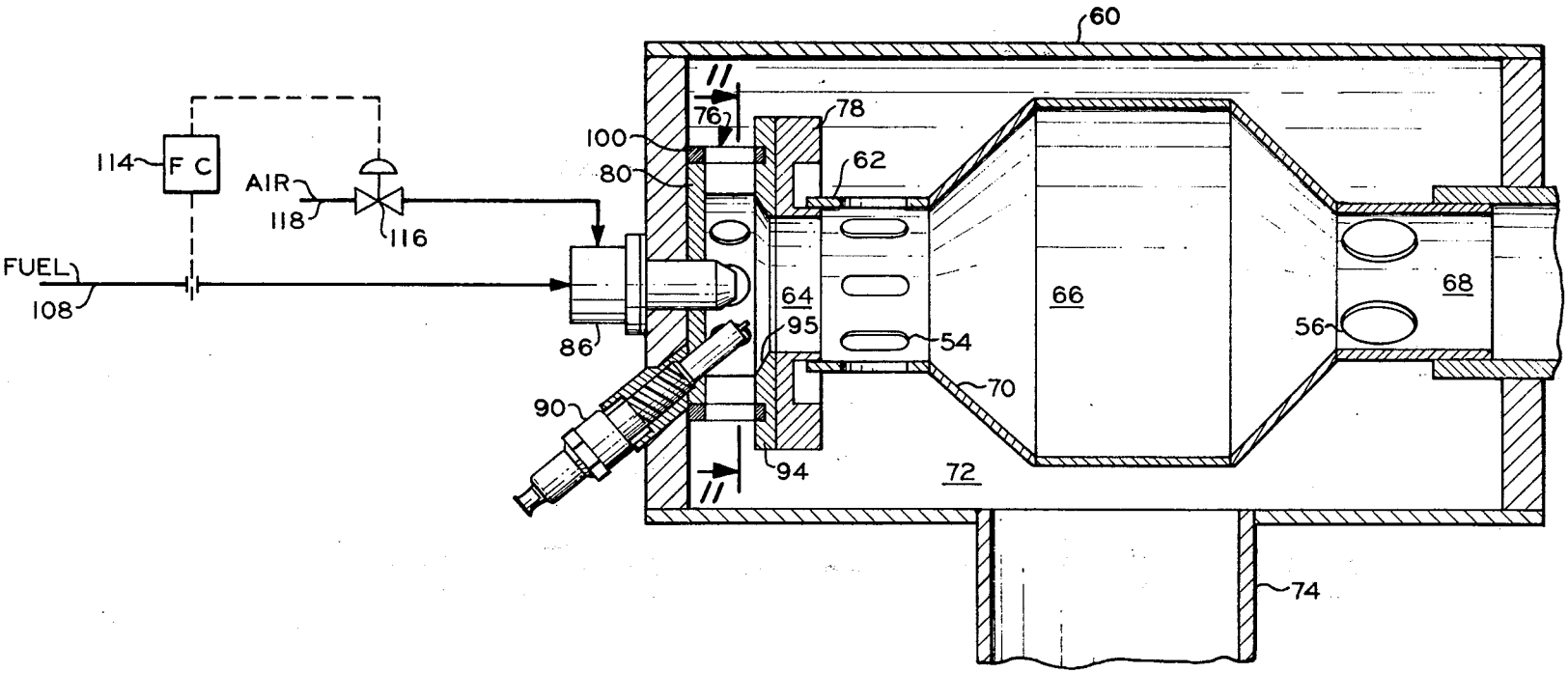

FIG. 7 illustrates another combustor in accordance with the invention. Said combustor comprises an outer housing or casing 60 having a flame tube 62 disposed therein. Said outer housing or casing can have any suitable shape or configuration. Said flame tube can be supported in said housing or casing by any suitable means. Said flame tube comprises a first combustion section 64 disposed in the upstream portion thereof, a second combustion section 66 located downstream from said first combustion section, and a dilution or quench section 68 located downstream from said combustion section. An annular connecting section 70 of greater cross sectional area than said first combustion section is disposed in the upstream portion of said second combustion section 66 and comprises the upstream end portion of said second combustion section. In one embodiment of the invention said connecting section 70 is tapered outwardly in a downstream direction as illustrated. Preferably, the intermediate portion of said second combustion section 66 is enlarged and has a greater cross sectional area then said connecting section. Said first, connecting, and second sections are preferably generally circular in cross section. An annular chamber 72 is formed around said flame tube 62 and between said flame tube and said outer housing or casing 60. Said annular chamber 72 is closed at its downstream end and at its upstream end by any suitable means, such as that illustrated. The closure means for said annular chamber can conveniently comprise means for supporting the flame tube 62 therein. An air conduit 74 is connected to said housing or casing 60 and is in communication with said annular chamber 72. Said air conduit 74 can be connected to any suitable source of heated air, such as from the regenerator. The upstream end of said flame tube 62 is closed by a dome or closure member designated generally by the reference numeral 76, and having fuel inlet means and air inlet means incorporated therein. As here illustrated, said dome or closure member 76 is mounted on the upstream end of said flame tube by means of an adaptor 78. Said adaptor can comprise any suitable adaptor and/or said dome member can be mounted on said flame tube by any other suitable connecting means.

Referring to FIGS. 8, 9, 10, and 11, said dome member 76 comprises a fixed generally cylindrical member 80 closed at one end and open at the other end. A plurality of openings 82 are provided at spaced apart locations around the circumference of said cylindrical member 80 adjacent the closed end thereof. An opening 84 is provided in said closed end for receiving a fuel inlet nozzle means 86 which extends through the end member of housing or outer casing 60. Said fuel inlet nozzle means 86 can be any suitable type of fuel nozzle. As here shown it is an air assist fuel nozzle of conventional design wherein air is used in atomizing the fuel. Another opening 88 is provided in said closed end for receiving an igniter means 90 which also extends through said end plate of housing 60. Openings 92 are provided for receiving mounting bolts (not shown) for mounting the dome member in housing or casing 60. Preferably, a mounting flange 94 is connected to and provided around the open end of said cylindrical member 80. Preferably, a groove 96 is provided in said flange 94 around the open base of said cylindrical member 80. A pair of spaced-apart stop pins 98 project from said flange 94 perpendicular thereto and adjacent said cylindrical member 80. An orifice 95, preferably tapered inwardly, is provided in said flange 94 adjacent and in communication with the open end of said cylindrical member 80.

An adjustable throttle ring 100 is mounted around said cylindrical member 80 and is provided with a plurality of spaced apart openings 102 therein of a size, number, and shape and at spaced apart locations, corresponding to said openings 82 in cylindrical member 80. Said throttle ring 100 fits into groove 96 in flange 94. An actuator pin 104 projects outwardly from the outer surface of said throttle ring 100 and coacts with said stop pins 98 to limit the movement of said ring 100. Friction lugs 106 are provided on the top and the bottom of said ring 100 for bearing against the inner surface of housing 60 and the bottom of groove 96, respectively.

Figure 12:
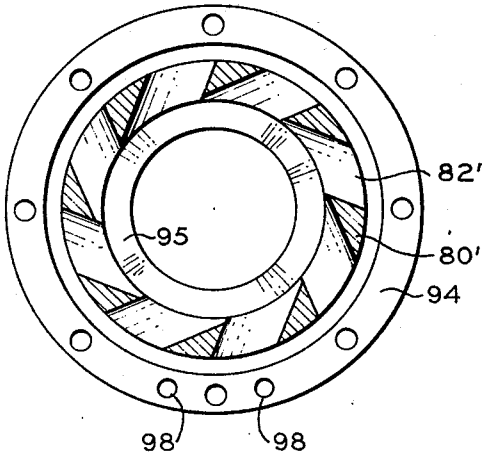
FIG. 12 is a sectional view, taken through a location corresponding to that of FIG. 11, and illustrating features of another dome member which can be employed on the combustors of the invention and in the operation of said combustors.

FIG. 12 illustrates a modified cylindrical member 80' which can be employed in a modification of said dome or closure member 76. Said modified cylindrical member 80' is essentially like the cylindrical member 80 shown in FIGS. 10 and 11 except that openings 82' in the modified cylindrical member 80' extend tangentially therethrough instead of radially. It will be understood that the corresponding openings in the corresponding modified throttle ring (not shown) which is employed with said modified cylindrical member 80' are correspondingly tangential.

In accordance with the invention, it has been found that when the combustors of the invention are provided with air assist fuel inlet nozzles, it is desirable to control the amount of air supplied to the fuel nozzle in accordance with the fuel flow to said nozzle. Any suitable control means can be employed for this purpose and the specific means illustrated in FIG. 7 forms no part, per se, of the invention and can be modified or substituted for as desired. As shown diagrammatically in FIG. 7, the flow controller 114 actuates valve 116 in air conduit 118 responsive to the flow of fuel through the orifice in fuel conduit 108 to program an increase in air flow to nozzle 86 to accompany an increase in fuel flow, or vice versa. Said valve 116 can be a pressure regulator valve for holding a constant pressure in the conduit downstream therefrom and to fuel nozzle 86.

Further in accordance with the invention, it has been found that when the combustors of the invention are provided with variable dome means, such as dome 76 in FIG. 7, it is desirable to control the effective open area of the air inlet openings in said dome member in accordance with fuel flow through the combustor. Any suitable control means can be provided for this purpose and, referring now to FIG. 8, the specific means there illustrated forms no part, per se, of the present invention and can be modified or substituted for by any means known in the art. As shown diagrammatically in FIG. 8, controller 109, responsive to the flow of fuel through the orifice in fuel conduit 108, actuates linkage 110, which is operatively connected to control rod 111, and programs rotation of said control rod in one direction or the other. Yoke member 112 is fixed to the inboard end of rod 111 inside of housing 60. The U-shaped recess in the end of yoke member 112 coacts with actuator pin 104 to cause rotation of throttle ring 100 within the limits of the space between stop pins 98 and thus adjust the effective size of the opening provided by openings 82 and 102. As here shown, said openings 82 and 102 are in direct register with each other to provide the maximum opening into dome 76. Indicator pin 113 is provided to indicate the degree of rotation of throttle ring 100. If desired, dome 76 can be operated manually by means of a knob (not shown) on the end of shaft 111.

It will be understood that the other combustors of the invention can be provided with a variable dome means, such as the above described dome member 76, and the control means associated therewith, if desired. It will also be understood that the other combustors of the invention can be provided with an air assist fuel nozzle and the air control means associated therewith, if desired.

The operation of the combustor of FIG. 7 is similar to the operation described above for the combustors of FIGS. 5 and 6. In one method of operation, a stream of heated air from any suitable source, e.g., the regenerator, is supplied via conduit 74 to annular chamber 72 in the interior of housing or casing 60. From said chamber 72 a swirling first stream of air is introduced via the inlet openings in dome member 76 into the upstream end of first combustion section or region 64. A stream of fuel is admitted via conduit 108 and fuel nozzle 86 axially of said stream of air. A combustible mixture of said fuel and air is formed ignited so as to cause combustion thereof.

As second stream of air from annular chamber 72 is introduced via openings 54 into the interior of the flame tube at a location between first combustion section 64 and second combustion section 66. Said air is introduced into said mixture in segmented form as a plurality of spaced apart individual streams of air from said openings 54. The resulting mixture is passed via annular connecting section 70, and expanded during said passage, into the enlarged portion of second combustion section 66. Another stream of air from annular chamber 72 is passed via openings 56 into the downstream end portion of the flame tube as diluent or quench air.

Figure 15:
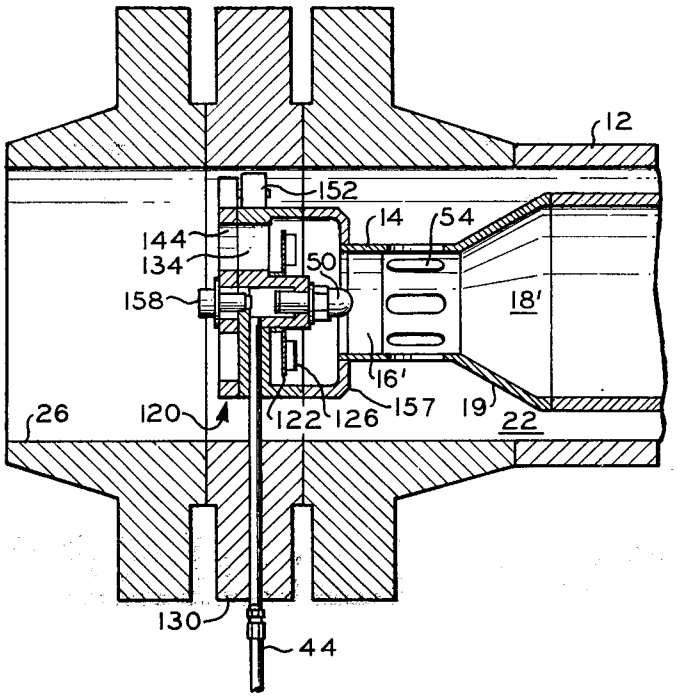
FIG. 15 is a view, partially in cross section, of another combustor in accordance with the invention.
Figure 16:
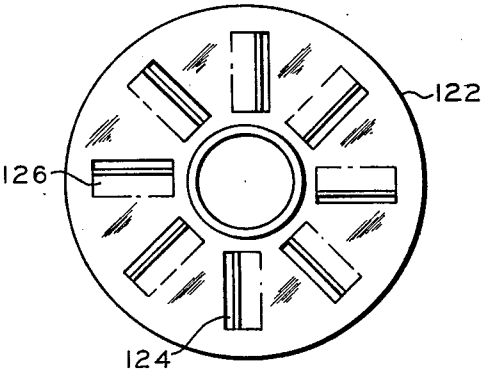
FIG. 16 is a view in elevation of the swirl plate element of the dome member of the combustor of FIG. 15.

FIG. 15 illustrates the upstream portion of another combustor in accordance with the invention. The downstream portion (not shown) of said combustor is like the downstream portion of the combustor of FIG. 5. The remainder of said FIG. 15 combustor is essentially like said FIG. 5 combustor except for the provision in FIG. 15 of the variable dome member designated generally by the reference numeral 120, small changes in the size of the openings 54, and the omission of conduit 28. FIG. 16 is an elevation view looking at the downstream face of swirl plate 122 which is mounted around the fuel inlet nozzle and slightly downstream from the openings in the variable dome 120. Said plate 122 is provided with a plurality of openings 124 therein which are spaced apart around the plate. A deflector plate or tab 126 is disposed downstream from each said opening 124. The structure of said plate 122 is substantially like that of plate 34 in FIGS. 3 and 4 except for the number of openings in plate 122.

Figure 17:
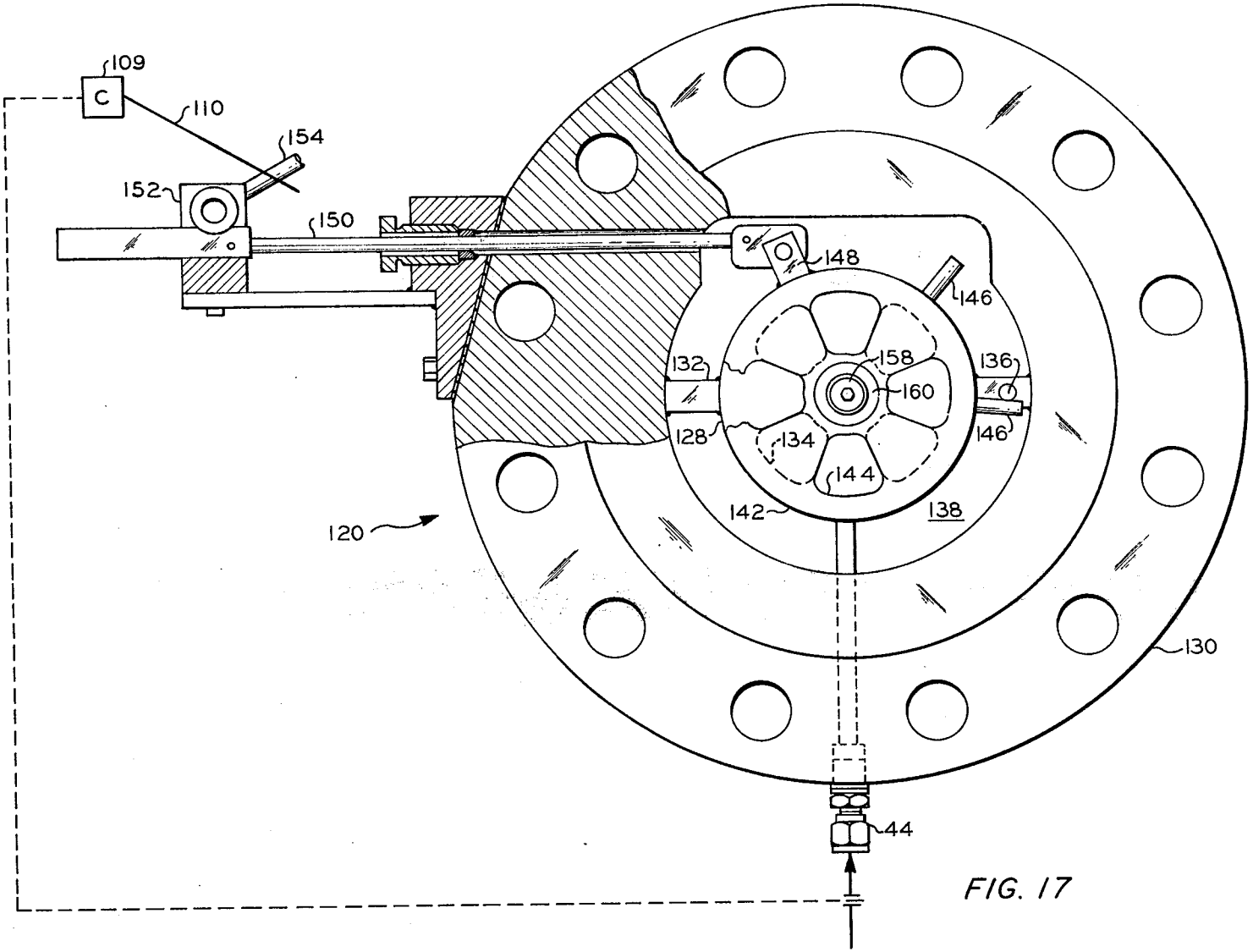
FIG. 17 is a view looking at the upstream side of the dome of the combustor of FIG. 15.
Figure 18:
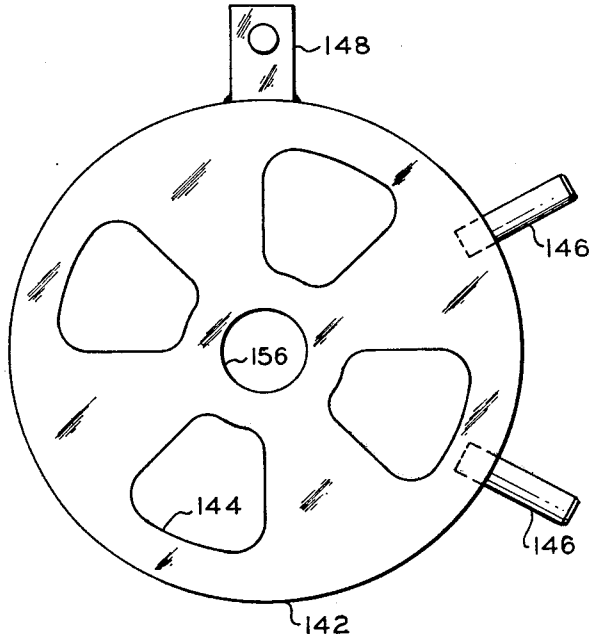
FIG. 18 is a view in elevation of an element of the dome of the combustor of FIG. 15.
Figure 19:
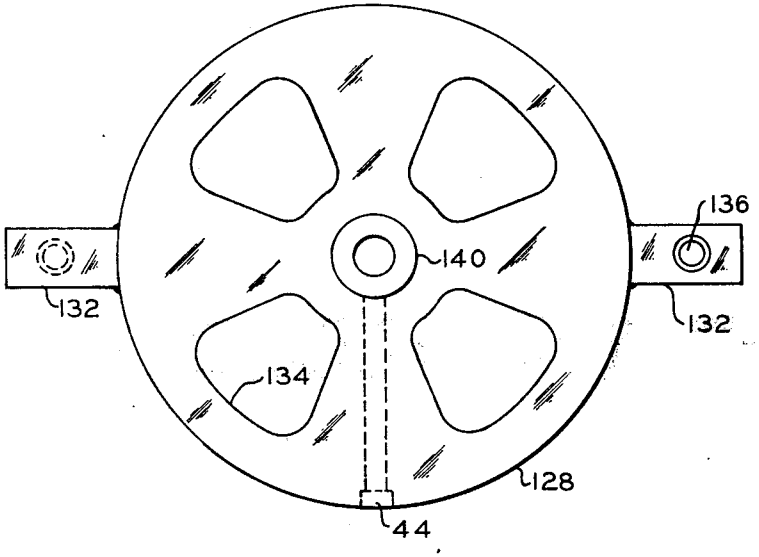
FIG. 19 is a view in elevation of another element of the dome of the combustor of FIG. 15.

Referring to FIGS. 17, 18, and 19, said dome member 120 comprises a fixed circular back plate 128 centrally mounted in an opening 138 provided in fuel flange 130 by means of a pair of mounting bars 132. A plurality of spaced apart openings 134, arranged in a circle, are provided in said plate 128. A stop pin 136 projects perpendicularly from one of said bars 132. Said opening 138 in fuel flange 130 is in communication with annular space 22 and conduit 26 of the combustor of FIG. 15 for admitting heated air to said annular space 22. A centrally disposed circular boss member 140 projects outwardly from the upstream face of said fixed plate 128 for receiving and mounting a front adjustable plate 142 thereon.

Said front plate 142 is circular, the same as, and of the same size as, said fixed plate 128. A plurality of spaced apart openings 144 are provided in said front plate 142 and correspond in size and circular arrangement to that of said openings 134 in backplate 128. A pair of spaced apart stop pins 146 project perpendicularly from the side of said front plate 142. An actuator tab 148 projects perpendicularly from one side of said front plate at a location spaced from said stop pins 146. Push rod 150 is pivotally connected to said actuator tab 148 in any suitable manner as shown. Said push rod 150 can be actuated in a back and forth manner by means of roller mechanism 152 mounted on the outside of fuel flange 130 in any suitable manner. Flexible shaft 154 extends through a control panel (not shown) and is connected to a rotatable knob (not shown) for manual movement of said shaft 154, said roller mechanism 152, and said rod 150 for rotating said front plate 142 within the limits imposed by stop pins 146 acting against stop pin 136.

In assembly, said fuel flange 130 is mounted between adjacent flanges as shown in FIG. 15. The upstream end of flame tube 14 fits onto adaptor 157 which is secured to the downstream face of said fuel flange 130. Fuel conduit 44 extends through said flange 130 and communicates with a central cavity therein which is adapted to receive fuel nozzle 50 mounted therein. The central opening 156 in front plate 142 fits onto boss member 140 on backplate 128 and said front plate is held in sliding engagement with backplate 128 by means of cap screw 158 and washer 160. Said push rod 150, by virtue of the back and forth movement described above, rotates said front plate 142 to bring openings 144 therein into and out of register with openings 134 in said backplate 128 to thus vary the effective size of opening provided in variable dome 120 and vary the amount of air passed through said dome into first combustion section 16'. As shown in FIG. 15, said openings 144 and 134 are in full register and the dome member is completely open. As shown in FIG. 17, said openings are out of register and the dome member is completely closed.

As discussed above in connection with the combustor of FIG. 7 and its variable dome member 76, it is desirable to control the effective size of the openings in the variable dome 120 of the FIG. 15 combustor in accordance with fuel flow to the combustor. This can be accomplished manually by means of the push rod 150 and associated elements. However, in continuously operating combustors which operate over a varied range of operating conditions, such as a driving cycle as described in the examples hereinafter, it is desirable that the effective size of the dome openings be controlled automatically. Any suitable control means can be provided for this purpose, for example, the control means described above and illustrated in FIG. 8. Said control means can be adapted to the combustor of FIG. 15 by providing an orifice in fuel conduit 44, operatively connecting said orifice to a controller unit 109, and operatively connecting said controller unit by a suitable linkage 110 to shaft 154 of rack and roller mechanism 152 which moves push rod 150 back and forth.

The operation of the combustor of FIG. 15 is similar to that described above for the combustors of FIGS. 5 and 6. In one method of operation of the FIG. 15 combustor a stream of heated air is supplied to conduit 26 from any suitable source, e.g., air which has been passed through the regenerator. A first stream of air is admitted through variable dome 120 to the first combustion section or region 16'. The baffles or tabs 126 on swirl plate 122 impart a swirling motion to said first stream of air. The volume of said first stream of air can be controlled or programmed by controller 109 in accordance with the fuel flow through fuel conduit 44 to nozzle 50. The remainder of the operation is like that described for the combustors of FIGS. 5 and 6, with a second stream of heated air being introduced into the interior of the flame tube via openings 54 as described above.

Figure 20:
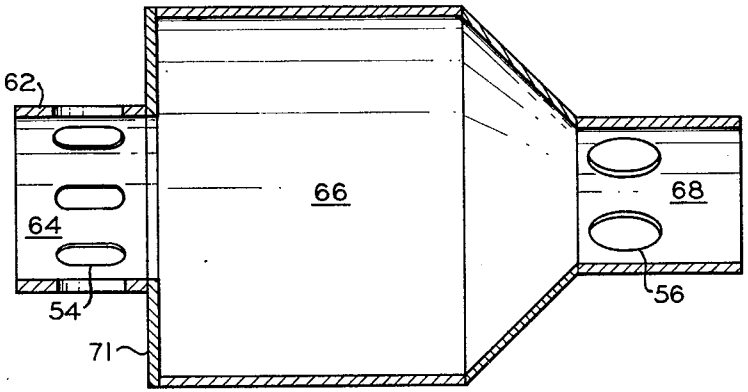
FIG. 20 is a view in cross section of another flame tube which can be employed in the combustor of FIG. 7.

When the flame tube of FIG. 20 is employed in the combustors of the invention, e.g., the combustor of FIG. 7, the operation of the combustors so equipped is similar to that described above for said combustor 7. A principal difference in the flame tube of FIG. 20 is that the tapered connecting section 70 of the flame tube in the combustor of FIG. 7 has been replaced with an essentially flat annular extending inner surface 71 disposed adjacent and downstream from said openings 54, preferably in close proximity to said openings. Said flat inner surface provides for the abrupt expansion of the mixture and combustion products from the combustion thereof which are passed from the first combustion region to the second combustion region. In operation, turbulent, eddy currents are set up downstream from said surface 71. Said eddy currents serve as flame holders and/or flame stabilizers.

Figure 21:
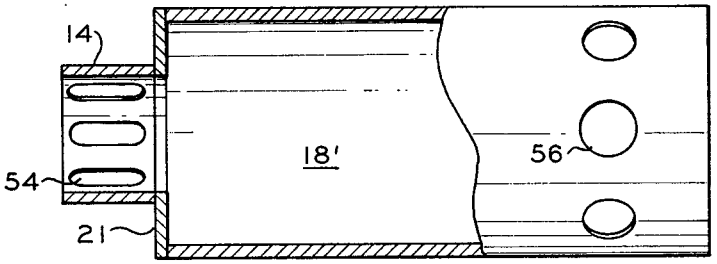
FIG. 21 is a view in cross section of another flame tube which can be employed in the combustor of FIG. 5.

When the flame tube of FIG. 21 is employed in combustors of the invention, e.g., the combustors of FIGS. 5, 6, and 15, the operation is simiar to that described above for said combustors 5, 6, and 15. A principal difference in the flame tube of FIG. 21 is that the tapered connecting section 19 of the flame tubes in the combustors of FIGS. 5, 6, and 15 has been replaced with an essentially flat annular radially extending inner surface 21 disposed adjacent and downstream from said openings 54, preferably in close proximity to said openings. Said flat inner surface provides for the abrupt expansion of the mixture and combustion products from the combustion thereof which are passed from the first combustion region to the second combustion region. In operation, turbulent eddy currents are set up downstream from said surface 21. Said eddy currents serve as flame holders and/or flame stabilizers.

Figure 8:
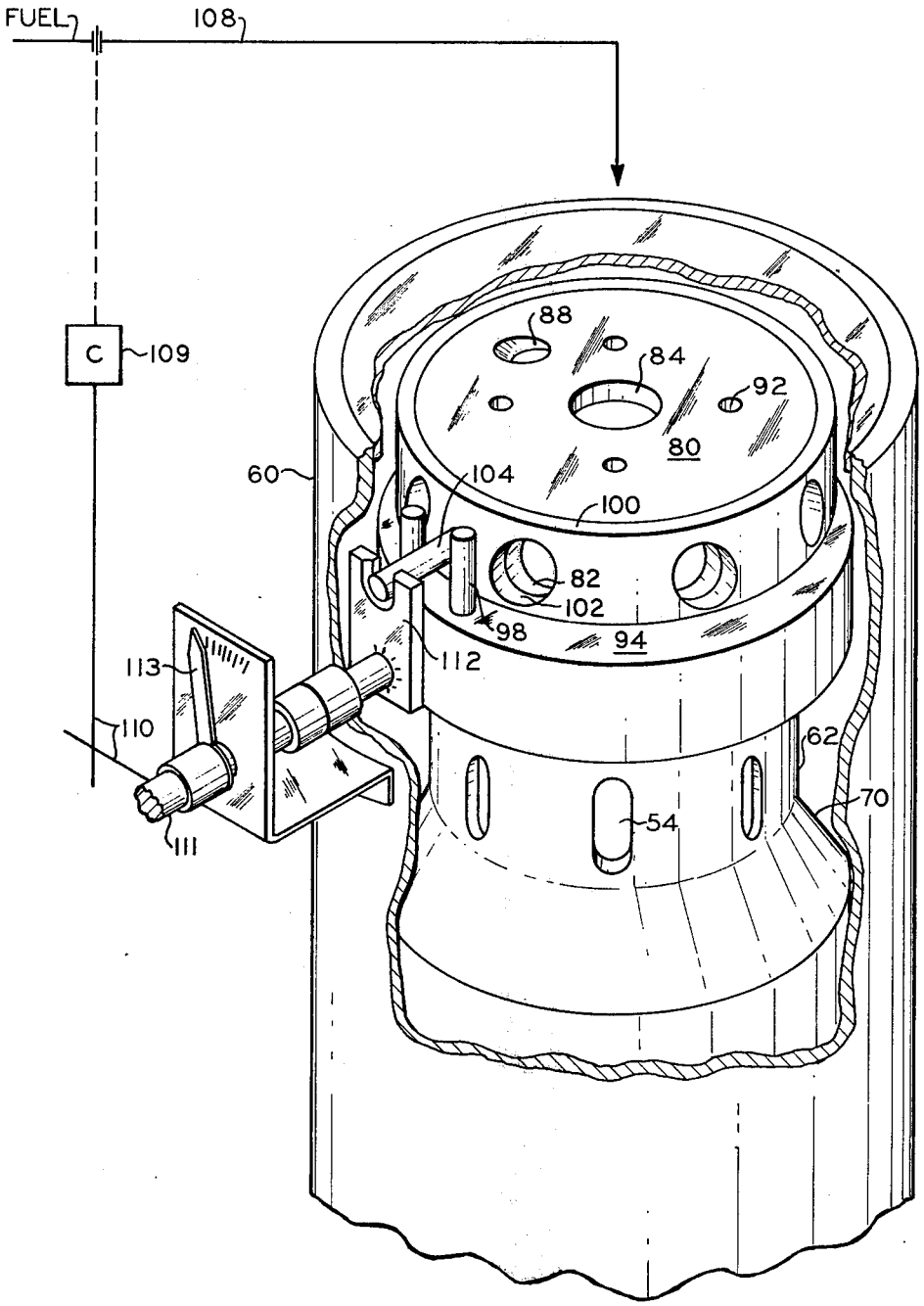
FIG. 8 is a diagrammatic perspective view, partially cut away, of the upstream end of the flame tube and dome member thereof of the combustor of FIG. 7, and further illustrating certain operational features thereof.
Figure 11:
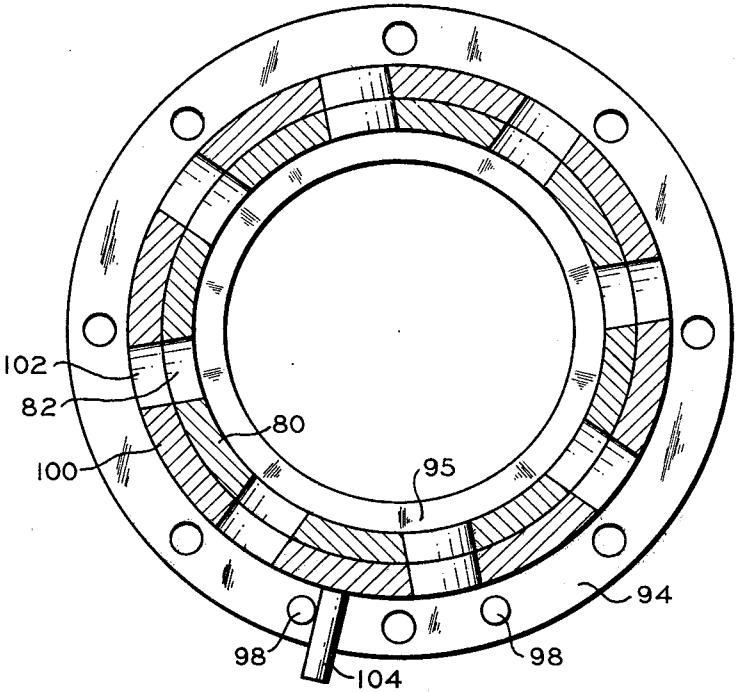
FIG. 11 is a sectional view taken along the line 11—11 of FIG. 7.
Figure 9:
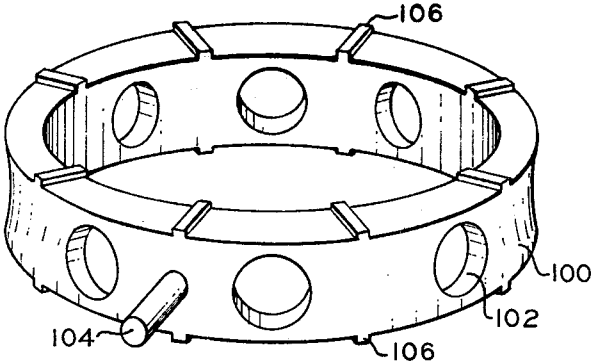
FIG. 9 is a perspective view further illustrating an element of the dome member of the combustor of FIG. 7.
Figure 10:
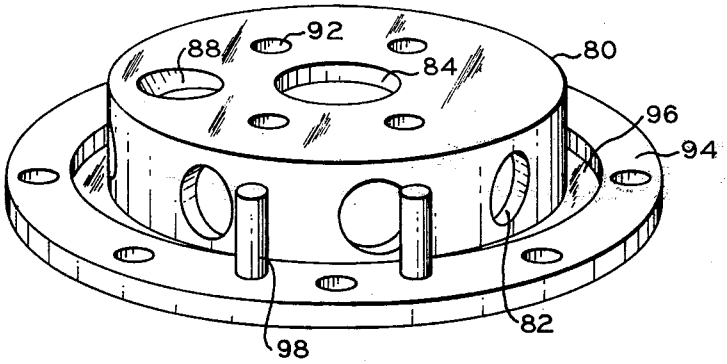
FIG. 10 is a perspective view further illustrating another element of the dome member of the combustor of FIG. 7.
Figure 14:
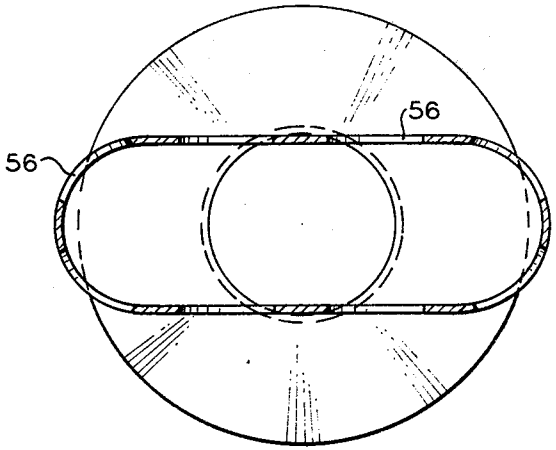
FIG. 14 is a sectional view taken along the line 14—14 of FIG. 13.
Figure 13:
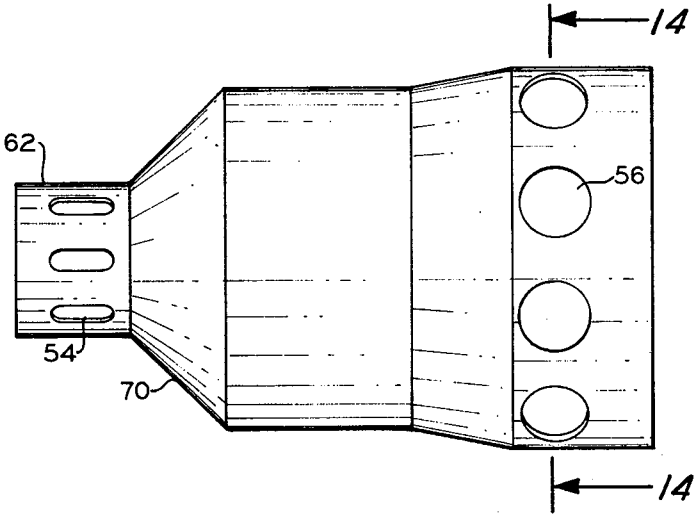
FIG. 13 is a top plan view of the flame tube of the combustor of FIG. 7.

In the above-described methods of operation the relative volumes of the various streams of air can be controlled by varying the sizes of the said openings, relative to each other, through which said streams of air are admitted to the flame tube of the combustor. The above described variable dome 76 of FIG. 7 and the variable dome of FIGS. 8, 9, and 10 are employed to control the volume of air to the first combustion region. Flow meters or calibrated orifices can be employed in the conduits supplying said other streams of air, if desired.

It is within the scope of the invention to operate the combustors or combustion zones of the invention under any conditions which will give the improved results of the invention. For example, it is within the scope of the invention to operate said combustors or combustion zones at inlet air temperatures within the range of from ambient to about 1500° F., or higher, depending upon materials of construction; at pressures within the range of from about 1 to about 40 atmospheres, or higher; at flow velocities within the range of from about 1 to about 500 feet per second, or higher; and at heat input rates within the range of from about 30 to about 1200 Btu per pound of air. Since some embodiments of the invention provide for reducing the temperature of the first stream of air supplied to the first combustion region of the combustion zone to values less than those normally employed, so as to reduce nitrogen oxides emissions, it is preferred in these embodiments that the temperature of said first stream of air be within the range of from ambient to about 700° F., more preferably from ambient to about 500° F. In said embodiments the temperature of the second stream of air supplied to the second combustion region will preferably be greater than the temperature of said first stream of air. The temperature of the second stream of air should be at least about 100° F., preferably at least about 200° F., e.g., up to about 1200° F., or more, greater than the temperature of said first stream of air, depending upon the temperature of said first stream of air. Generally speaking the upper limit of the temperature of the second stream of air will be determined by the means employed to heat same, e.g., the capacity of the regenerator or other heating means. Generally speaking, operating conditions in the combustors of the invention will depend upon where the combustor is employed. For example, when the combustor is employed with a high pressure turbine, higher pressures and higher inlet air temperatures will be employed in the combustor. Thus, the invention is not limited to any particular operating conditions. As a further guide to those skilled in the art, but not to be considered as limiting on the invention, presently preferred operating ranges for other variables or parameters are: heat input, from 30 to 500 Btu/lb. of total air to the combustor; combustor pressure, from 3 to 10 atmospheres; and reference air velocity, from 50 to 250 feet per second.

The relative volumes of the above-described first, second, and quench or dilution air streams will depend upon the other operating conditions. Generally speaking the volume of the first stream of air introduced into the first combustion region will usually be in the range of from 0 to 50, preferably about 2 to about 35, volume percent of the total air to the combustor when operating over a driving cycle including idling, low speed, moderate speed, high speed, acceleration, and deceleration. When operating under substantially "steady state" conditions, such as in a stationary power plant or in turnpike driving, the volume of said first stream of air will usually be in the range of from 1 to 35, preferably about 2 to 18, volume percent of the total air to the combustor. Under both said driving cycle conditions and said steady state conditions, the volume of the second stream of air will usually be in the range of from 10 to 60, preferably 15 to 45 volume percent of the total air to the combustor. The volume of the dilution or quench air can be any suitable amount of sufficient to accomplish its intended purpose.

In these embodiments of the invention wherein the air pressure to an air assist fuel nozzle is varied in accordance with the fuel flow, the air pressure to said fuel nozzle can be in the range of from 1 to 100, preferably 2 to 15, psig greater than the combustor operating pressure, preferably measuring said combustor pressure by the air inlet pressure thereto.

While in most instances, said first stream of air, said second stream of air, and said dilution of quench air will originate fron one common source such as a single compressor, it is within the scope of the invention for said streams of air to originate from different or separate sources. For example, in those embodiments of the invention using unheated air in the first combustion region the unheated air can be supplied from a source different from that of the second stream of air and the dilution or quench air, e.g., a separate air pump or compressor. It is also within the scope of the invention for the heated second stream of air to be supplied from a separate source. Separate heating means can be provided for heating said second stream of air, if convenient.

A number of advantages are realized in the practice of the invention. The combustors of the invention are low emission combustors. The invention provides small compact combustors which are particularly well suited to be employed in locations where space is important, e.g., under the hood of an automobile. Yet, the principles involved and the advances provided by the invention are applicable to combustors employed in larger power plants, e.g., large stationary gas turbine engines. The variable employed in combination with the flame tubes in the combustors of the invention contribute to the overall efficiency of the combustors of the invention. Said variable dome is located in relatively cool low stress region of the combustor, i.e., at the upstream end of the flame tube. Said variable dome is small component comprising only one movable element which operates with only a small movement from a closed position to an open position. Thus, rapid response to changing operating conditions is provided. This combination of a variable dome with the relatively small flame tubes of the combustors of the invention renders said combustors of the invention particularly well suited for mobile installations. In contrast, the "variable hardware" of the prior art combustors usually provides for adjustments at a plurality of locations in the combustors, including adjustments to the hot flame tube itself. The result is usually a large, bulky, unit which in practical operation functions poorly, if at all.

While it is not intended to limit the invention as to any theories of operation, it appears that the combustors of the invention are, to a large extent at least, what can be termed "self adjusting" in operation. By this it is meant that the fuel-air mixtures produced and burned have characteristics of adjusting or varying in accordance with fuel flow. As the fuel flow increases the spray of fuel penetrates farther into the first combustion section and involves more of the second stream of air introduced through the air slots 54. Thus, an adjustment takes place which is a function of the amount of fuel injected. In accordance with the invention the second stream of air introduced through said slots 54 is introduced as a segmented stream of air comprising a plurality of individual streams of air. It will be noted that said slots 54 extend over a significant portion of the length of said first combustion section. Thus, the individual streams of air in said segmented second stream of air are admitted to said first combustion section over a significant portion of the length thereof. It is presently believed that at low fuel flows the regions between said individual streams of air are relatively low pressure regions, and some air from said individual streams of air circulates into said regions of relatively low pressure. Fuel droplets and/or vapor penetrate or are drawn into said regions of relatively low pressure and combustible mixtures are formed. Said mixtures are burned and the flame is seated or stabilized in said regions of relatively low pressure. Then, as fuel flow is increased to higher fuel flows said combustible mixtures become richer and richer until the flame in said relatively low pressure regions is, in effect, extinguished and the flame moves downstream in the flame tube, past the second air stream injection slots, and is ultimately stabilized or seated at moderate to high fuel flows in the second combustion region of the combustor.

The above action of the flame is in the combustors of the invention has actually been observed by looking into the flame tube through observation ports at the downstream end thereof. At low fuel flows and with the flame stabilized in said regions of relatively low pressure, said regions of relatively low pressure between the plurality of individual streams of air are filled with blue flame, the walls are red, and the incoming streams of air are black. When the flame is stabilized in the second combustion region of the combustor the flame has the appearance of a light blue haze at low $NO_x$ producing conditions.

The following examples will serve to further illustrate the invention. In each of said examples a series of test runs was made to evaluate combustors of the invention over a range of operating conditions as set forth therein.

EXAMPLE 1

A series of runs was carried out employing combustor A as a control combustor and combustors B and C of the invention. The purpose of this testing program was to evaluate the performance of said combustors when operating with unheated air being supplied to the primary combustion region of combustor A and the first combustion region of combustors B and C, from conduit 28. Such use of unheated air simulates the use of bypass air, i.e., air which has not been passed through the regenerator, in a gas turbine engine. Heated air was introduced through openings 54 of each combustor. In these runs each combustor was operated over a test program consisting of six different driving conditions which simulate a vehicle traveling over a driving cycle. Said six driving conditions were deceleration, idling, low speed, moderate speed, high speed, and acceleration, listed in the order of increasing rate of heat input (fuel-to-air ratio). The conditions employed in each of said six driving conditions are set forth in Table I below.

At each of the six driving conditions, runs were carried out using four different levels or amounts of unheated air in the primary or first combustion region of the combustors. This produced a total of 24 test conditions. At each of said 24 test conditions the temperature of the unheated air was in the range of 75° to 110° F. The volume of the unheated air used was controlled by metering same into the combustors. The volume of the second stream of air to the second combustion section and the volume of the quench or dilution air were determined by the open entry hole sizes to each said region. At each of said 24 test conditions the exhaust gas from the combustor was analyzed under specifically controlled conditions to determine the concentration of $NO_x$, CO, and unburned hydrocarbon (HC). In general, in said analyses the SAE recommended sampling procedure was followed, i.e., "Procedure For The Continuous Sampling and Measurement of Gaseous Emissions From Aircraft Turbine Engines," Society of Automotive Engineers, Inc., New York, Aerospace Recommended Practice 1256, (October 1971).

From the raw data thus obtained, the emission index (pounds of pollutant produced per 1000 pounds of fuel burned) was calculated for $NO_x$, CO, and HC. For comparison purposes, one test run was selected (from the four different levels of unheated air used) which would minimize overall emissions at each of the six driving conditions for each combustor.

The configuration of combustor A was like that illustrted in FIG. 1. The configuration of combustor B was like that illustrated in FIG. 5. The configuration of combustor C was like that illustrated in FIG. 6. Design details for said combustors are set forth in Table II below. Emission index values, and other data, from said selected test runs are set forth for the three combustors in Tables III, IV, and V, respectively, below. Emission ratio values weighted over the entire driving cycle on the basis of time and fuel burned for each driving condition are also given. Said emission ratio values provide a convenient overall evaluation of combustor performance.

EXAMPLE II

Another series of test runs was carried out employing said combustors A, B, and C of Example I, and employing substantially the same test procedures, except that heated air was used in the primary or first combustion region of the combustors. For this example said combustors are designated A-1, B-1, and C-1, respectively. The purpose of the test program of this example was to evaluate said combustors when using heated air in the primary or first combustion region, and only one run at each of the six operating or driving conditions was made. In the test program of this example the configurations of said combustors A-1, B-1, and C-1 were like those illustrated in FIGS. 1, 5, and 6, respectively, except that the conduits 28 for supplying unheated air to the primary or first combustion regions were omitted. The combustor was supplied with heated air from conduit 26. Emission index values and other data, including emission ratio values, for said combustors in this series of runs are set forth in Tables VI, VII, and VIII below.

EXAMPLE III

Another series of test runs was carried out employing two modifications of combustor B-1 of Example II. For this example these modified combustors are designated B-2 and B-3. It will be rembered that combustor B-1 of Example II was like combustor B of Example I (see FIG. 5) except that the conduit 28 for supplying unheated air to the first combustion region was omitted. In combustors B-2 and B-3 a variable dome was provided on the flame tube whereby the amount of air admitted to the first combustion region could be varied. Additionally, in combustor B-2 the air openings or slots 54 were changed from 1.00 to 0.75 inch in length; and in combustor B-3 said openings or slots 54 were changed from 1.00 to 1.25 inch in length. The configurations of said combustors B-2 and B-3 were like that illustrated in FIG. 15, with the downstream portion (not shown) of the combustors being like that of the combustor shown in FIG. 5. Design details for said combustors B-2 and B-3 are given in Table IX below which also includes details of combustor B-1 for comparison.

In the runs of this example heted air was supplied through the variable dome to the first combustion region of said combustors B-2 and B-3 from conduit 26. In the testing procedure of this example a series of runs was made at each driving condition employing various dome openings (percent of total open hole area in flame tube and dome) to determine the optimum dome open area for lowest $NO_x$ emissions without losing control of the CO and HC emissions. Otherwise, the testing procedure employed was substantially like that of Example II. Emission index values and other data, including emission ratio values, for said combustors at said optimum dome openings are set forth in Tables X and XI below.

TABLE I

TEST CONDITIONS FOR EVALUATING COMBUSTOR PERFORMANCE

| Simulated Federal Driving Cycle | | Combustor Operating Conditions | | | | |
|---|---|---|---|---|---|---|
| Condition | Time, % Total | Inlet Air Pressure, in. Hg abs | Inlet Air Temp., F.(a) | Air Flow, lb/sec.(b) | Fuel Flow, lb/hr.(c) | Heat Input, Btu/lb.Air |
| Deceleration | 10 | 90 | 1200 | 1.40 | 13.5 | 50 |
| Idle | 20 | 45 | 1000 | 0.72 | 10.5 | 75 |
| Low Speed | 40 | 55 | 1200 | 0.89 | 19.0 | 110 |
| Moderate Speed | 10 | 70 | 1200 | 1.14 | 31.8 | 145 |
| High Speed | 10 | 90 | 1200 | 1.40 | 48.6 | 180 |
| Acceleration | 10 | 45 | 1000 | 0.72 | 41.8 | 300 |

(a)For secondary air and quench air in Example I; for primary air, secondary air, and quench air in Example II.

(b)Absolute humidity controlled at 75 grains of water vapor per pound of dry air.

(c)ASTM Jet A aviation-turbine kerosine.

TABLE II

| Combustor Number | COMBUSTOR DESIGN A | B* | C** |
|---|---|---|---|
| Dome | | | |
| Primary Air | Unheated | | |
| Inlet Type | Slotted-Plate Swirler | | |
| Hole Diameter, in. | 0.313 | | |
| Number of Holes | 6 | | |
| Total Hole Area, sq.in. | 0.460 | | |
| Radiation Shield Diameter, in. | 1.000 | | |
| Nozzle Annulus Area, sq.in. | 0.635 | | |
| % Total Combustor Hole Area | 4.215 | | 3.681 |
| Fuel Nozzle Type | Simplex (Monarch) | | |
| Spray Pattern | Hollow Cone | | |
| Spray Angle, deg. | 45 | | |
| Flame Tube | | | |
| Secondary Air | Heated | | |
| 1st Station Diameter, in. | 2.067 | | |
| Length from Fuel Inlet, in. | 3.00 | 1.00 | |
| Hole Diameter, in. | 0.31 × 1.00 | | |
| Number of Holes | 8 | | |
| Total Hole Area, sq.in. | 2.500 | | |
| % Total Combustor Hole Area | 22.910 | | 20.006 |
| Quench Air | Heated | | |
| 2nd Station Diameter, in. | 4.026 | | |
| Length from Fuel Inlet, in. | 10.00 | | 11.75 |
| Hole Diameter, in. | 1.125 | | 0.75 × 1.75 |
| Number of Holes | 8 | | |
| Total Hole Area, sq.in. | 7.952 | | 9.536 |
| % Total Combustor Hole Area | 72.873 | | 76.312 |
| Combustor Length, in. | 10.00 | | 11.75 |
| Primary Zone, in. | 3.00 | 1.00 | |
| Secondary Zone, in. | 7.00 | 9.00 | 10.75 |
| Combustor Volume, cu. in. | 79.4 | 98.2 | 120.5 |
| Primary Zone, cu. in. | 10.1 | 3.4 | |
| Secondary Zone, cu. in. | 69.3 | 94.8 | 117.1 |
| Combustor Hole Area, sq. in. | 10.912 | | 12.496 |
| Combustor Exit Area | 85.718 | | 98.161 |

*Modification of Combustor A with shorter primary zone (1'') and longer secondary zone (9''). Only values that were changed are shown.

**Modification of Combustor B with longer secondary zone (10.75) and more quench air (0.75 × 1.75) slots. Only values that were changed are shown.

TABLE III

| Simulated Driving Condition | PERFORMANCE OF COMBUSTOR NO. A Emission Index, gm Pollutant/kgm Fuel $NO_x$ | CO | HC | Exhaust Smoke, Optical Density | Pressure Drop, % | Bypass Air Flow, % Total |
|---|---|---|---|---|---|---|
| Deceleration | 4.20 | 21.92 | 0.24 | 0.000 | 2.8 | 2.64 |
| Idle | 2.26 | 21.67 | 0.16 | 0.000 | 0.0 | 2.97 |
| Low Speed[d] | 1.93 | 7.39 | 0.18 | 0.000 | 0.9 | 5.81 |
| Moderate Speed[d] | 1.92 | 3.46 | 0.07 | 0.000 | 1.4 | 11.49 |
| High Speed[d] | 2.30 | 2.86 | 0.00 | 0.000 | 2.8 | 14.26 |
| Acceleration | 2.20 | 6.22 | 0.05 | 0.000 | 0.0 | 23.77 |
| | Emission Ratio[a] | | | | | |
| Federal Driving Cycle | 1.66 | 0.69 | 0.08 | | | |

Note: (Applicable to all of Tables III-VIII).

[a] $\frac{\text{Amount of pollutant emitted over simulated Federal Driving Cycle}^{(b)}}{\text{Amount of pollutant permitted by 1976 Statutory Requirement}^{(c)}}$

[b] Calculated for 10 miles per gallon fuel economy with typical kerosine-type fuel.

[c] 0.4 g/mile $NO_x$, 3.4 g/mile CO, and 0.41 g/mile HC.

[d] Low speed = up to about 20 miles/hr; moderate speed = about 20 to about 40 miles/hr; and high speed = above about 40 miles/hr.

TABLE IV

| Simulated Driving Condition | PERFORMANCE OF COMBUSTOR NO. B* Emission Index, gm Pollutant/kgm Fuel $NO_x$ | CO | HC | Exhaust Smoke, Optical Density | Pressure Drop, % | Bypass Air Flow, % Total |
|---|---|---|---|---|---|---|
| Deceleration | 3.69 | 22.71 | 0.27 | 0.000 | 4.3 | 1.98 |
| Idle | 1.47 | 42.76 | 0.31 | 0.000 | 3.3 | 2.97 |
| Low Speed (d) | 0.75 | 12.68 | 0.10 | 0.000 | 4.1 | 8.72 |
| Moderate Speed (d) | 1.02 | 3.12 | 0.04 | 0.000 | 3.3 | 11.49 |
| High Speed (d) | 1.14 | 2.23 | 0.03 | 0.000 | 3.3 | 14.26 |
| Acceleration | 1.82 | 12.58 | 0.07 | 0.000 | 2.2 | 27.17 |
| | Emission Ratio[a] | | | | | |

TABLE IV-continued

| Simulated Driving Condition | PERFORMANCE OF COMBUSTOR NO. B* Emission Index, gm Pollutant/kgm Fuel $NO_x$ | CO | HC | Exhaust Smoke, Optical Density | Pressure Drop, % | Bypass Air Flow, % Total |
|---|---|---|---|---|---|---|
| Federal Driving Cycle | 0.97 | 1.10 | 0.08 | | | |

*Values in this Table IV are the average of three runs.

TABLE V

| Simulated Driving Condition | PERFORMANCE OF COMBUSTOR NO. C Emission Index, gm Pollutant/kgm Fuel $NO_x$ | CO | HC | Exhaust Smoke, Optical Density | Pressure Drop % | Bypass Air Flow, % Total |
|---|---|---|---|---|---|---|
| Deceleration | 2.23 | 28.56 | 0.29 | 0.000 | 1.8 | 3.96 |
| Idle | 0.91 | 12.97 | 0.28 | 0.000 | 1.1 | 5.94 |
| Low Speed | 0.87 | 2.64 | 0.15 | 0.000 | 1.8 | 8.72 |
| Moderate Speed | 1.01 | 3.39 | 0.11 | 0.000 | 2.1 | 16.41 |
| High Speed | 1.00 | 9.27 | 0.48 | 0.000 | 2.2 | 20.38 |
| Acceleration | 4.81 | 8.80 | 0.04 | 0.000 | 2.7 | 23.77 |
| | Emission Ratio[a] | | | | | |
| Federal Driving Cycle | 1.28 | 0.68 | 0.16 | | | |

TABLE VI

| Simulated Driving Condition | PERFORMANCE OF COMBUSTOR NO. A-1 Emission Index, gm Pollutant/kgm Fuel $NO_x$ | CO | HC | Exhaust Smoke, Optical Density | Pressure Drop, % |
|---|---|---|---|---|---|
| Deceleration | 10.85 | 15.68 | 0.17 | 0.000 | 4.3 |
| Idle | 2.78 | 16.00 | 0.24 | 0.000 | 3.1 |
| Low Speed (d) | 4.10 | 5.10 | 0.08 | 0.000 | 4.4 |
| Moderate Speed (d) | 6.41 | 3.15 | 0.06 | 0.000 | 7.9 |
| High Speed (d) | 12.41 | 2.83 | 0.00 | 0.000 | 7.6 |
| Acceleration | 8.59 | 4.08 | 0.04 | 0.000 | 2.2 |
| | Emission Ratio[a] | | | | |
| Federal Driving Cycle | 5.42 | 0.51 | 0.05 | | |

TABLE VII

| Simulated Driving Condition | PERFORMANCE OF COMBUSTOR NO. B-1 Emission Index, gm Pollutant/kgm Fuel $NO_x$ | CO | HC | Exhaust Smoke, Optical Density | Pressure Drop, % |
|---|---|---|---|---|---|
| Deceleration | 5.53 | 11.83 | 0.24 | 0.000 | 4.4 |
| Idle | 2.22 | 15.64 | 0.20 | 0.000 | 4.4 |
| Low Speed (d) | 3.99 | 3.33 | 0.10 | 0.000 | 5.4 |
| Moderate Speed (d) | 6.06 | 2.76 | 0.06 | 0.000 | 6.4 |
| High Speed (d) | 11.75 | 2.84 | 0.05 | 0.000 | 5.6 |
| Acceleration | 14.01 | 4.64 | 0.05 | 0.000 | 4.4 |
| | Emission Ratio[a] | | | | |
| Federal Driving Cycle | 5.72 | 0.44 | 0.07 | | |

TABLE VIII

| Simulated Driving Condition | PERFORMANCE OF COMBUSTOR NO. C-1 Emission Index, gm Pollutant/kgm Fuel $NO_x$ | CO | HC | Exhaust Smoke, Optical Density | Pressure Drop, % |
|---|---|---|---|---|---|
| Deceleration | 5.66 | 3.96 | 0.29 | 0.000 | 4.0 |
| Idle | 2.05 | 2.78 | 0.26 | 0.000 | 2.2 |
| Low Speed (d) | 4.64 | 2.94 | 0.10 | 0.000 | 4.4 |
| Moderate Speed (d) | 12.07 | 3.87 | 0.11 | 0.000 | 4.9 |
| High Speed (d) | 36.05 | 3.74 | 0.05 | 0.000 | 4.7 |
| Acceleration | 8.46 | 3.92 | 0.06 | 0.000 | 2.7 |
| | Emission Ratio | | | | |
| Federal Driving Cycle | 9.54 | 0.31 | 0.08 | | |

TABLE IX

| Combustor Number | COMBUSTOR DESIGN B-1 | B-2* | B-3** |
|---|---|---|---|
| Dome | | | |
| Primary Air | Heated | | |
| Inlet Type | Slotted-Plate Swirler | Variable,& Swirl Plate | |
| Hole Diameter,in. | 0.313 | 0.94 × 0.94 | |
| Number of Holes | 6 | 4 | |
| Total Hole Area,sq.in. | 0.460 | 0 to 3.548 | |
| Radiation Shield Diameter,in. | 1.000 | None | |
| Nozzle Annulus Area,sq.in. | 0.635 | — | |
| % Total Combuster Hole Area | 4.215 | 0 to 26.556 | 0 to 24.259 |
| Fuel Nozzle Type | Simplex (Monarch) | | |
| Spray Pattern | Hollow Cone | | |
| Spray Angle,deg. | 45 | | |
| Flame Tube | 23 | 97 | 102 |
| Secondary Air | Heated | | |
| 1st Station Diameter, in. | 2.067 | | |
| Length from Fuel Inlet,in. | 1.00 | | |
| Hole Diameter,in. | 0.31 × 1.00 | 0.31 × 0.75 | 0.31 × 1.25 |
| Number of Holes | 8 | | |
| Total Hole Area,sq.in. | 2.500 | 1.860 | 3.125 |
| % Total Combustor Hole Area | 22.910 | 18.956 to 13.922 | 28.211 to 21.367 |
| Quench Air | Heated | | |
| 2nd Station Diameter,in. | 4.026 | | |
| Length from Fuel Inlet,in. | 10.00 | | |
| Hole Diameter,in. | 1.125 | | |
| Number of Holes | 8 | | |
| Total Hole Area,sq.in. | 7.952 | | |
| % Total Combustor Hole Area | 72.873 | 81.043 to 59.520 | 78.912 to 54.372 |
| Combustor Length,in. | 10.00 | | |
| Primary Zone,in. | 1.00 | | |
| Secondary Zone,in. | 9.00 | | |
| Combustor Volume,cu.in. | 98.2 | | |
| Primary Zone,cu.in. | 3.4 | | |
| Secondary Zone,cu.in. | 94.8 | | |
| Combustor Hole Area,sq.in. | 10.912 | 9.812 to 13.360 | 11.077 to 14.625 |
| % Combustor Exit Area | 85.718 | 77.077 to 104.948 | 87.014 to 114.886 |

*Modification of Combustor B-1 with variable dome and shorter secondary air inlet openings (0.75").
**Modification of Combustor B-1 with variable dome and longer secondary air inlet openings. (1.25").

TABLE X

| Simulated Driving Condition | PERFORMANCE OF COMBUSTOR NO. B-2 Emission Index, gm Pollutant/kgm Fuel $NO_x$ | CO | HC | Exhaust Smoke, Optical Density | Pressure Drop, % | Dome Open Area, % Total |
|---|---|---|---|---|---|---|
| Deceleration | 4.38 | 22.89 | 0.40 | 0.000 | 5.0 | 4.01 |
| Idle | 1.53 | 17.77 | 0.42 | 0.000 | 4.7 | 5.12 |
| Low Speed (d) | 0.25 | 10.57 | 0.24 | 0.000 | 5.5 | 6.48 |
| Moderate Speed (d) | 0.81 | 3.42 | 0.00 | 0.000 | 7.0 | 7.80 |
| High Speed (d) | 5.80 | 2.84 | 0.00 | 0.000 | 4.4 | 17.84 |
| Acceleration | 6.19 | 4.73 | 0.04 | 0.000 | 6.2 | 0.00 |
| | Emission Ratio[a] | | | | | |
| Federal Driving Cycle | 2.18 | 0.73 | 0.11 | | | |

TABLE XI

| Simulated Driving Condition | PERFORMANCE OF COMBUSTOR NO. B-3 Emission Index, gm Pollutant/kgm Fuel $NO_x$ | CO | HC | Exhaust Smoke, Optical Density | Pressure Drop, % | Dome Open Area, % Total |
|---|---|---|---|---|---|---|
| Deceleration | 4.85 | 30.86 | 0.31 | 0.000 | 4.5 | 2.03 |
| Idle | 2.09 | 53.33 | 0.26 | 0.000 | 4.4 | 1.25 |
| Low Speed (d) | 0.65 | 11.65 | 0.29 | 0.000 | 4.9 | 0.00 |
| Moderate Speed (d) | 0.61 | 4.80 | 0.10 | 0.000 | 4.7 | 5.78 |
| High Speed (d) | 2.21 | 3.46 | 0.00 | 0.000 | 4.1 | 24.01 |
| Acceleration | 7.09 | 3.42 | 0.04 | 0.000 | 4.7 | 24.01 |
| | Emission Ratio[a] | | | | | |
| Federal Driving Cycle | 1.87 | 1.09 | 0.11 | | | |

Referring to the above Examples I and II, and comparing the results obtained in the operation of combustors A, B and C (see Tables III, IV and V) with the results obtained in the operation of combustors A-1, B-1, and C-1 (see Tables VI, VII, and VIII), it is evident that $NO_x$ and CO emissions are markedly reduced by using unheated air in the first combustion section. From these data it is concluded that the combustors of the invention are particularly well adapted to use unheated air in the first combustion section.

Referring to the above Examples II and III, and comparing the results obtained in the operation of combustor B-1 (see Table VII) with the results obtained in the operation of combustors B-2 and B-3 (see Tables X and XI), shows the advantages of employing a variable dome on the combustors of the invention and varying the amount of heated air admitted to the first combustion section in accordance with driving conditions (fuel flow). In these runs heated air was used in both the first and second combustion sections of the combustors. Thus, from these data, together with the data from Example I, it is concluded that the combustors of the invention can be operated to give low emissions of both $NO_x$ and CO over a wide range of operating conditions when using either unheated air or heated air in the first combustion section.

The use of heated air in all sections of the combustor is the normally preferred method of operation, for reasons of efficiency, e.g., fuel economy. However, in situations where efficiency and/or fuel economy is of lesser importance there are advantages (emission-wise) in using unheated air in the first combustion section. Thus, a combustor which can be operated to give low emissions when using either heated air or unheated air in the first combustion section is a valuable flexible combustor.

In control combustor A of the above examples the volume of the primary combustion section was 12.7 percent of the total or combined volume of the primary and secondary combustion sections. In combustors B and C of the invention the volume of the first combustion section was only 3.5 and 2.8 percent, respectively, of the toal or combined volume of the first and second combustion sections. The volume of the first combustion section in combustors B-1, B-2, and B-3 was the same as for combustor B. Thus, it is concluded that the relatively small volume of the first combustion section of the combustors of the invention is an important factor in the improved results obtained in the operation of said combustors. Based on observations (discussed above) during operation of said combustors, it is believed that the manner of introducing the segmented second stream of air into the flame tube of the combustors of the invention is another important cooperating factor in the improved results obtained in the operation of the combustors of the invention.

In some preferred embodiments of the present invention a steam of "unheated air" is supplied to the first combustion zone or section. Said unheated air can have a temperature greater than ambient temperatures. For example, the air from the discharge of a compressor, if not cooled, will usually have a temperature greater than ambient temperatures. Such a stream would be unheated air as the term is used herein. Thus, as used herein, said term unheated air refers to air which has not been intentionally heated. The temperature of said unheated air will usually be less than about 700° F., preferably less than about 500° F.

The term "air" is employed generically herein and in the claims, for convenience, to include air and other combustion-supporting gases.

The Emission Index values referred to herein were related to the various governmental agencies' standards by assuming that the vehicle in which the gas turbine engine is employed will obtain a fuel economy of 10.0 miles per gallon of fuel, and using a fuel weight of 6.352 pounds per gallon.

While the invention has been described with particular reference to combustors employed in combination with gas turbine engines, the invention is not limited thereto. The combustors of the invention have utility in other applications, e.g., boilers, other stationary power plants, etc.

Thus, while certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

What is claimed is:

1. A combustor comprising, in combination:

an outer casing;

a flame tube disposed within said casing and spaced apart therefrom to form a first annular chamber between said flame tube and said casing;

said flame tube having an upstream first combustion section, and a second combustion section located downstream from and adjoining said first combustion section, wherein the volume of said first combustion section is within the range of from 0.7 to 4 percent of the total volume of said first combustion section and said second combustion section;

a first air inlet means for introducing a first stream of swirling air into the upstream end portion of said flame tube;

a fuel inlet means for introducing fuel into the upstream end portion of said flame tube; and a plurality of openings provided in the wall of said flame tube at a first station located between said first combustion section and said second combustion section for admitting a segmented second stream of air from said annular chamber into the interior of said flame tube.

2. A combustor according to claim 1 wherein:

the volume of said first combustion section is within the range of from 2 to 4 percent of the total volume of said first combustion section and said second combustion section; and the overall ratio of the length to the cross sectional area of said first combustion section and said second combustion section is within the range of from 1.7 to about 5.

3. A combustor according to claim 2 wherein the ratio of the length to the cross sectional area of said first combustion section is less than 1.

4. A combustor according to claim 1 wherein:

a dome or closure member is disposed at the upstream end of said first combustion section; and said first air inlet means comprises at least one air passage means extending through said dome member into communication with said first combustion section; and a first air conduit is connected to said outer casing and communicates with said annular chamber.

5. A combustor according to claim 4 wherein:

said first air inlet means comprises a generally cylindrical swirl chamber formed in said dome member with the downstream end of said swirl chamber in communication with the upstream end of said first combustion section for introducing a swirling stream of air into said first combustion section, a plurality of air passages extending through said dome member from the upstream end thereof and into communication with said swirl chamber for introducing air into said swirl chamber, and means for imparting a swirl to said air being introduced into said swirl chamber;

said fuel inlet means comprises conduit means formed in said dome member and extending through said swirl chamber for introducing said fuel axially with respect to said swirling stream of air; and the downstream end portion of said dome member comprises an expansion passageway which flares outwardly from an opening in the downstream end of said swirl chamber to the inner wall of said first combustion section.

6. A combustor according to claim 5 wherein a second air conduit is disposed within said first air conduit and communicates with the upstream end portion of said dome member in a manner which is effective to exclude air in said first air conduit from entering said first air inlet means, but which is effective to permit air from said second air conduit to enter said first air inlet means.

7. A combustor according to claim 6 wherein:

the volume of said first combustion section is within the range of from 2 to 4 percent of the total volume of said first combustion section and said second combustion section; and the overall ratio of the length to the cross sectional area of said first combustion section and said second combustion section is within the range of from 1.7 to about 5.

8. A combustor according to claim 7 wherein the ratio of the length to the cross sectional area of said first combustion section is less than 1.

9. A combustor according to claim 1 wherein:

another plurality of openings is provided in the wall of said flame tube at a second station, located downstream from said first station, for admitting a third stream of air from said annular chamber into the interior of said flame tube; and said first air inlet means, said openings at said first station, and said openings at said second station are the only openings in said flame tube for admitting air into the interior thereof.

10. A combustor comprising, in combination:

an outer casing;

a flame tube disposed within said casing and spaced apart therefrom to form a first annular chamber between said flame tube and said casing;

said flame tube having an upstream first combustion section, and a second combustion section located downstream from and adjoining said first combustion section, wherein the volume of said first combustion section is within the range of from 0.7 to 4 percent of the total volume of said first combustion section and said second combustion section;

a dome or closure member disposed at the upstream end of said first combustion section and comprising at least one air passage means of variable cross-sectional area provided therein and extending therethrough into communication with said first combustion section for introducing a firse stream of swirling air into the upstream end portion of said flame tube, and means for varying the cross-sectional area of said air passage and controlling the amount of said first stream of air admitted to said first combustion section;

a fuel inlet means for introducing fuel into the upstream end portion of said flame tube; and a plurality of openings provided in the wall of said flame tube at a first station located between said first combustion section and said second combustion section for admitting a segmented second stream of air from said annular chamber into the interior of said flame tube.

11. A combustor according to claim 10 wherein:

the volume of said first combustion section is within the range of from 2 to 4 percent of the total volume of said first combustion section and said second combustion section; and the overall ratio of the length to the cross-sectional area of said first combustion section and said second combustion section is within the range of from 1.7 to about 5.

12. A combustor according to claim 11 wherein the ratio of the length to the cross-sectional area of said first combustion section is less than 1.

13. A combustor according to claim 4 wherein the ratio of the length of the cross-sectional area of said first combustion section is less than 0.75.

14. A combustor according to claim 10 wherein said means for varying the cross-sectional area of said air passage in said dome member includes means for varying said cross-sectional area in accordance with the rate of flow of fuel to said combustor.

15. A combustor according to claim 10 wherein:

another plurality of openings is provided in the wall of said flame tube at a second station, located downstream from said first station, for admitting a third stream of air from said annular chamber into the interior of said flame tube; and said first air inlet means, said openings at said first station, and said openings at said second station are the only openings in said flame tube for admitting air into the interior thereof.

16. A combustor according to claim 10 wherein the wall of said flame tube comprises an essentially flat annular radially extending inner surface disposed adjacent and downstream from said openings located at said first station.

17. A combustor comprising, in combination:

an outer casing;

a flame tube disposed within said casing and spaced apart therefrom to form a first annular chamber between said flame tube and said casing;

said flame tube having an upstream first combustion section, and a second combustion section located downstream from and adjoining said first combustion section, wherein the volume of said first combustion section is within the range of from 0.7 to 4 percent of the total volume of said first combustion section and said second combustion section;

a first air inlet means for introducing a first stream of swirling air into the upstream end portion of said flame tube;

a fuel inlet means for introducing fuel into the upstream end portion of said flame tube;

a plurality of openings provided in the wall of said flame tube at a first station located between said first combustion section and said second combustion section for admitting a segmented second stream of air from said annular chamber into the interior of said flame tube; and said wall of said flame tube comprising an essentially flat annular radially extending inner surface disposed adjacent and downstream from said openings located at said first station.

18. A method for burning a fuel in a combustion zone haivng a first upstream combustion region and a second combustion region located downstream from and adjoining said first combustion region, which method comprises:

providing a combustion zone having a said first combustion region and a said second combustion region are wherein the volume of said first combustion region, relative to the combined volume of said first combustion region and said second combustion region, is such that flame resulting from the combustion of a fuel in said combustion zone can be stabilized in said first combustion region during periods of low fuel and can be stabilized in said second combustion region during periods of moderate to high fuel flow;

introducing a stream of fuel into the upstream end portion of said first combustion region;

introducing a swirling first steam of air into said upstream end portion of said first combustion region and forming a combustible mixture of said fuel and said air;

causing ignition of said combustible mixture so as to cause combustion thereof;

introducing a segmented second stream of air into said mixture, at a location between said first combustion region and said second combustion region, as a plurality of individual streams of air spaced apart around said location and causing the formation of regions of relatively low pressure between said individual streams of air; and thereby causing the flame from said combustion to be stabilized in said regions of relatively low pressure during periods of low fuel flow, and causing said flame to be stabilized in said second combustion region during periods of high fuel flow.

19. A method according to claim 18 wherein the volume of said first combustion region is within the range of from 0.7 to 4 percent of the combined volume of said first combustion region and said second combustion region.

20. A method according to claim 19 wherein:

said first stream of air is introduced as unheated air; and said second stream of air is introduced at a temperature at least 500° F. greater than the temperature of said first stream of air.

21. A method according to claim 20 wherein the volume of said first stream of air is variable and is varied in accordance with the volume of said fuel introduced into said first combustion region.

22. A method according to claim 21 wherein:

said fuel is a normally liquid fuel and is introduced in finely divided state by the action of pressurized air thereon; and the pressure or the volume of said pressurized air is varied in accordance with the volume of said fuel being introduced

23. A method according to claim 22 wherein the pressure of said pressurized air is maintained within the range of from 2 to 15 psig greater than the pressure within said combustion zone.

24. A method according to claim 21 wherein the volume of said mixture and combustion products from said combustion thereof is abruptly expanded essentially immediately after entry into said combustion region.

25. A method according to claim 22 wherein the volume of said mixture and combustion products from said combustion thereof is abruptly expanded essentially immediately after entry into said second combustion region.

26. A method according to claim 19 wherein both said first and said second streams of air are heated to a temperature of at least about 900° F. prior to introduction into said combustion zone.

27. A method according to claim 26 wherein the volume of said first stream of air is variable and is varied in accordance with the volume of said fuel introduced into said first combustion region.

28. A method according to claim 27 wherein:

said fuel is a normally liquid fuel and is introduced in finely divided state by the action of pressurized air thereon; and the pressure or the volume of said pressurized air is varied in accordance with the volume of said fuel being introduced.

29. A method according to claim 27 wherein the volume of said mixture and combustion products from said combustion thereof is abruptly expanded essentially immediately after entry into said second combustion region.

30. A method according to claim 28 wherein the volume of said mixture and combustion products from said combustion thereof is abruptly expanded essentially immediately after entry into said second combustion region.

31. A method according to claim 30 wherein the pressure of said pressurized air is maintained within the range of from 2 to 15 psig greater than the pressure within said combustion zone.

32. A method according to claim 18 wherein:

a third stream of air comprising quench air is introduced into said combustion zone downstream from the location of the introduction of said second stream of air and downstream from said second combustion region; and said first stream of air, said second stream of air, and said third stream of air are the only streams of air introduced into said combustion zone.

33. A method according to claim 19 wherein:

the volume of said first stream of air is variable and is varied in accordance with the volume of said fuel introduced into said first combustion region; and said first stream of air, said second stream of air, and said third stream of air are the only streams of air introduced into said combustion zone.

34. A method according to claim 33 wherein:

said fuel is a normally liquid fuel and is introduced in finely divided state by the action of pressurized air thereon; and the pressure or the volume of said pressurized air is varied in accordance with the volume of said fuel being introduced.

35. A method according to claim 34 wherein the pressure of said pressurized air is maintained within the range of from 2 to 15 psig greater than the pressure within said combustion zone.

36. A method for burning a fuel in a combustion zone having a first upstream combustion region and a second combustion region located downstream from and adjoining said first combustion region, which method comprises:

providing a combustion zone having a said first combustion region and a said second combustion region and wherein the volume of said first combustion region, relative to the combined volume of said first combustion region and said second combustion region, is such that the flame resulting from the combustion of a fuel in said combustion zone can be stabilized in said first combustion region during periods of low fuel flow and can be stabilized in said second combustion region during periods of moderate to high fuel flow;

introducing a stream of fuel into the upsteam end portion of said first combustion region;

introducing a swirling first stream of air at a controlled but variable rate into said upstream end portion of said first combustion region and forming a combustible mixture of said fuel and said air;

causing ignition of said combustible mixture so as to cause combustion thereof;

introducing a segmented second stream of air into said mixture at a location between said first combustion region and said second combustion region, as a plurality of individual streams of air spaced apart around said location and causing the formation of regions of relatively low pressure between said individual streams of air;

varying the volume of said first stream of air in accordance with the rate of introduction of said fuel; and thereby causing the flame from said combustion to be stabilized in said regions of relatively low pressure during periods of low fuel flow and to be stabilized in said second combustion region during periods of high fuel flow.

37. A method for burning a fuel in a combustion zone having a first upstream combustion region and a second combustion region located downstream from and adjoining said first combustion region, which method comprises:

providing a combustion zone having a said first combustion region and a said second combustion region and wherein the volume of said first combustion region is within the range of from 0.7 to 4 percent of the combined volume of said first combustion region and said second combustion region;

introducing a stream of fuel into the upstream end portion of said first combustion region;

introducing a swirling first stream of air into said upstream end portion of said first combustion region and forming a combustible mixture of said fuel and said air;

causing ignition of said combustible mixture so as to cause combustion thereof;

introducing a segmented second stream of air into said mixture, at a location between said first combustion region and said second combustion region, as a plurality of individual streams of air spaced apart around said location and causing the formation of regions of relatively low pressure between said individual streams of air; and thereby causing the flame from said combustion to be stabilized in said regions of relatively low pressure during periods of low fuel flow, and causing said flame to be stabilized in said second combustion region during periods of high fuel flow.

* * * * *